US010752464B2

(12) United States Patent
Toye et al.

(10) Patent No.: US 10,752,464 B2
(45) Date of Patent: Aug. 25, 2020

(54) FABRIC ROLL UP CORE FOR CARRYING SHEET MATERIAL

(71) Applicant: NINE IP LIMITED, Auckland (NZ)

(72) Inventors: Jonathan Dallas Toye, Auckland (NZ); Suzanne Elizabeth Foy, Silverdale (NZ)

(73) Assignee: NINE IP LIMITED, Auckland (NZ)

( * ) Notice: Subject to any disclaimer, the term of this patent is extended or adjusted under 35 U.S.C. 154(b) by 294 days.

(21) Appl. No.: 15/749,911

(22) PCT Filed: Jul. 20, 2016

(86) PCT No.: PCT/IB2016/054299

§ 371 (c)(1),
(2) Date: Feb. 2, 2018

(87) PCT Pub. No.: WO2017/021807

PCT Pub. Date: Feb. 9, 2017

(65) Prior Publication Data

US 2018/0222713 A1 Aug. 9, 2018

(30) Foreign Application Priority Data

Aug. 4, 2015 (NZ) ..... 710698

(51) Int. Cl.
*B65H 75/08* (2006.01)
*B65H 75/26* (2006.01)
(Continued)

(52) U.S. Cl.
CPC ..... *B65H 75/08* (2013.01); *B65H 75/10* (2013.01); *B65H 75/26* (2013.01); *B65H 75/30* (2013.01); *B65H 75/34* (2013.01); *B65H 2701/113* (2013.01); *B65H 2701/534* (2013.01); *B65H 2701/535* (2013.01)

(58) Field of Classification Search
CPC ..... B65H 75/08; B65H 75/10; B65H 75/26; B65H 75/30; B65H 75/34; B65H 2701/113; B65H 2701/534; B65H 2701/535
See application file for complete search history.

(56) References Cited

U.S. PATENT DOCUMENTS 1,469,304 A 10/1923 Hughes
1,577,326 A * 3/1926 Leon ..... G06C 11/12 116/200

(Continued)

FOREIGN PATENT DOCUMENTS

CA 1 234 527 A 3/1988
CN 2094535 U 1/1992

(Continued)

*Primary Examiner* — Michael E Gallion
(74) *Attorney, Agent, or Firm* — Seed IP Law Group LLP

(57) ABSTRACT

A fabric roll up core for carrying rolls of sheet material such as ground covers or canopy sheet materials including netting materials, used in agriculture or horticulture, such as bird, insect, hail, shade, wind barrier netting materials, comprises a profile formed in an outer surface that assists in maintaining the sheet material on the fabric roll up core when rolling the sheet material onto the fabric roll up core and which may be effective to work with roll up drive means. The core may be formed in one piece or as multiple connected parts.

21 Claims, 18 Drawing Sheets

(51) Int. Cl.

| | |
|---|---|
| ***B65H 75/30*** | (2006.01) |
| ***B65H 75/10*** | (2006.01) |
| ***B65H 75/34*** | (2006.01) |

(56) References Cited

U.S. PATENT DOCUMENTS

| | | | | | |
|---|---|---|---|---|---|
| 1,882,012 | A * | 10/1932 | Hires | B65H 75/18 | 242/160.1 |
| 2,113,701 | A * | 4/1938 | Mayer | B65H 75/08 | 242/571 |
| 2,388,774 | A * | 11/1945 | Tice | B65H 75/10 | 242/613.2 |
| 2,688,452 | A * | 9/1954 | Higginbotham | B65H 75/10 | 242/613.2 |
| 2,868,475 | A * | 1/1959 | Stern | B65H 75/08 | 242/118.4 |
| 3,519,216 | A * | 7/1970 | Rienzi | B65H 75/185 | 242/599.2 |
| 3,722,929 | A * | 3/1973 | Gilman | B65H 75/08 | 403/359.6 |
| 3,840,194 | A * | 10/1974 | Vetter | B65H 75/185 | 242/613.5 |
| 4,135,677 | A * | 1/1979 | Warczak | B65H 75/243 | 242/571.1 |
| 4,191,342 | A * | 3/1980 | Reinhold | B65H 75/242 | 242/599.1 |
| 4,315,608 | A * | 2/1982 | Bettenhausen | B65H 75/10 | 242/599 |
| 4,324,370 | A * | 4/1982 | Guard | E04H 4/101 | 242/403 |
| 4,487,378 | A * | 12/1984 | Kobayashi | A47K 10/16 | 242/160.1 |
| 5,271,575 | A * | 12/1993 | Weinert | B65H 18/04 | 242/520 |
| 5,961,063 | A * | 10/1999 | Parry | B65H 16/005 | 242/422.4 |
| 6,305,638 | B1 * | 10/2001 | Rodriguez | B65H 75/08 | 242/530.4 |
| 9,227,374 | B2 * | 1/2016 | Haque | B31C 5/00 | |
| 2003/0127555 | A1 * | 7/2003 | Squires | B41J 32/00 | 242/597.6 |
| 2006/0214049 | A1 * | 9/2006 | Hernandez | B29C 53/564 | 242/610.1 |
| 2012/0199684 | A1 * | 8/2012 | Tzur | B65H 75/187 | 242/160.4 |
| 2018/0257889 | A1 * | 9/2018 | Walters | B65H 75/30 | |

FOREIGN PATENT DOCUMENTS

| | | | |
|---|---|---|---|
| CN | 201217585 | Y | 4/2009 |
| CN | 202670933 | U | 1/2013 |
| FR | 2988710 | A | 3/2012 |
| GB | 2 153 037 | A | 8/1985 |
| GB | 2179627 | A | 3/1987 |
| JP | 2004091099 | A | 3/2004 |
| JP | 2014210647 | A | 11/2014 |
| NL | 6812519 | A | 3/1970 |
| WO | WO 2005/000494 | A1 | 1/2005 |

* cited by examiner

FABRIC ROLL UP CORE FOR CARRYING SHEET MATERIAL

FIELD OF INVENTION

The invention relates to fabric roll up cores for carrying rolls of sheet material, and particularly but not exclusively to fabric roll up cores for carrying rolls of sheet materials including netting materials for use in agriculture or horticulture, such as ground covers or canopy sheet materials or bird, insect, hail, shade, wind barrier or other netting materials, and a method for configuring a sheet material for storage or transportation.

RELATED APPLICATIONS

This application derives priority from New Zealand patent application number 710698, filed 4 Aug. 2015, the contents of which are incorporated herein by reference.

BACKGROUND

Typically where a sheet material including a netting material is used in an orchard or vineyard for example, the material is rolled out in lengths onto the ground beneath or between rows of trees or vines, or rows of berry fruit plants, or over rows or trees or vines, and is secured in place.

The sheet material will typically remain in place for some months, before being removed and reused in a subsequent growing season or on another crop in the same growing season.

One method of transporting the material, or of storing the material when not in use, is to roll it onto a cardboard core or a smooth outer surface plastic core. Such cores are often of length up to 6 m long. Because of their length, such cores are cumbersome and difficult to store or transport when not in use or in the transportation from factory or warehouse to the end customer. A further problem associated with long cores is that the length of the core may result in the inefficient utilization of space in shipping containers.

Another problem of cardboard cores, or plastic cores with a smooth outer surface, is a tendency for the core to slip when being rotated against the material, which is a particular problem when the material is machine or mechanically wound onto the core. The fabric is typically taped to the core or manually wound onto the core to overcome this. This manual activity adds extra work that the operator may need to perform.

A further problem may be a difficulty in maintaining the material straight on the core as it is being wound, or rolled thereon, either by hand or machine.

Another issue with cardboard cores, or plastic cores with a simple circular profile in transverse cross-section, is that to gain enough rigidity in the core to hold a load of the material so it can be handled it needs to have a large diameter with thick walls. This adds to the costs of making such a core and generates handling issues with heavier cores.

Another issue is that a core with a simple circular profile core in transverse cross section, when used with a rotating drive means such as a drive shaft attached to a hydraulic motor, may require a locking pin through the core and the drive means to ensure that the power is delivered to enable the material can be wound. Insertion and removal of a locking pin can be time consuming.

An alternative to using a cardboard or plastic core is to simply roll the material into rolls of material without any core. However, such rolls are floppy along their length and therefore difficult to manage, especially when redeploying in a subsequent season. They also do not stack as well as a roll containing a rigid core (for example they cannot be stood on their end), and are therefore more limited in terms of storage options.

It is an object of the present invention to provide improved fabric roll up cores for carrying sheet materials, which in at least some embodiments are improved in relation to at least one of the above, or a method for configuring a sheet material for storage or transportation, or to at least provide the public with a useful choice.

SUMMARY OF INVENTION

In a first aspect the invention provides a fabric roll up core for carrying a sheet material comprising a profile formed in an outer surface of the fabric roll up core along a length of the fabric roll up core that assists in maintaining the sheet material on the fabric roll up core, at least when rolling the sheet material onto the fabric roll up core.

In some embodiments the profile comprises a plurality of ribs extending along the length of the fabric roll up core.

In a second aspect the invention provides a fabric roll up core for carrying a sheet material, the fabric roll up core being substantially hollow along its length, made of a plastic material, and having a plurality of ribs extending longitudinally along an inner and/or outer surface of the fabric roll up core, said ribs increasing the longitudinal rigidity of the fabric roll up core and effective to work in conjunction with a rotating drive means of generally complimentary shape and without slipping when the rotating drive means is inserted at least 30 mm, or at least 50 mm, into an end of the fabric roll up core (i.e. fabric roll up core acting as socket), or when the fabric roll up core is inserted at least 50 mm into the drive means (i.e. drive means acting as socket), and rotating with a torque force of at least 4 Nm. In some embodiments the torque force is at least 5 Nm, or 6 Nm, or 8 Nm. In some embodiment the torque force is at least 10 Nm, or 15 Nm, or 20 Nm, or 30 Nm, or 40 Nm, or 50 Nm, or 60 Nm, or 80 Nm, or 100 Nm, or 150 Nm, or 200 Nm, or 300 Nm, or 400 Nm, or 600 Nm, or 800 Nm, or 1000 Nm.

In some embodiments the fabric roll up core is made substantially of polyolefins or polyvinyl chloride.

In some embodiments the at least one rib or ribs have a height of greater than about 1 mm, or about 1 mm to 10 mm, 1 mm to 8 mm, 1.5 mm to 6 mm, or 2 mm to 5 mm, or 2 mm to 4 mm.

In some embodiments the ribs have walls that are substantially planar and protrude from the surface of the fabric roll up core at an angle of at least 45°, or at least 50°, or at least 55°, or at least 60°.

In some embodiments the fabric roll up core has a wall thickness of between 3 and 6 mm.

In some embodiments the profile is unidirectional around a circumference or outer surface of the fabric roll up core part.

In some embodiments the profile comprises a plurality of ribs extending along the length of the fabric roll up core and the ribs are symmetrical in transverse cross sectional profile, or where they are asymmetric in transverse cross sectional profile.

In some embodiments a first side of each rib slopes from an outer circumference of the fabric roll up core towards a centre line of the rib more than an opposite second side of the rib.

In some embodiments the first side slopes towards the centreline of the rib and the second side is approximately aligned radially relative to the centre of the fabric roll up core.

In some embodiments the first side slopes towards the centreline of the rib and the second side is approximately parallel to a radial centreline of the rib.

In some embodiments the first side slopes towards the centreline of the rib and the second side slopes from the outer circumference away from the centre line of the rib.

In some embodiments the fabric roll up core is generally circular in cross-sectional profile.

In some embodiments the fabric roll up core has a diameter, measured across the outer surface of the fabric roll up core and including any ribs, of about 20 mm to 200 mm, 40 mm to 150 mm, or 50 mm to 125 mm, or 50 mm to 100 mm, or 50 mm to 90 mm, or 60 mm to 80 mm, or 55 to 65 mm, or 90 to 110 mm.

In some embodiments the fabric roll up core is generally square, or rectangular, or of geometric shape other than generally circular, in transverse cross sectional profile.

In some embodiments the fabric roll up core has a maximum cross-sectional width, measured across the outer surface of the fabric roll up core and including any ribs, of about 20 mm to 200 mm, 40 mm to 150 mm, or 50 mm to 125 mm, or 50 mm to 100 mm, or 50 mm to 90 mm, or 60 mm to 80 mm or 55 to 65 mm.

In some embodiments the profile comprises about 4 to 30 ribs, or 5 to 25 ribs, or 6 to 20 ribs, or 8 to 18 ribs, or 10 to 16 ribs, or 12 to 14 ribs spaced apart circumferentially around the fabric roll up core.

In some embodiments the profile extends along the full length of the fabric roll up core.

In some embodiments a wall of the fabric roll up core comprises a plurality of radially outwardly stepped portions and a plurality of radially inwardly stepped portions, the outwardly stepped portions and the inwardly stepped portions alternating around the circumference or periphery of the fabric roll up core, the outwardly stepped portions forming the ribs of the profile extending along the length of the fabric roll up core, and the inwardly stepped portions forming the recesses of the profile along the length of the fabric roll up core.

In some embodiments the fabric roll up core has a constant cross-section shape along its length.

In some embodiments the fabric roll up core is substantially hollow along its length.

In some embodiments the fabric roll up core is substantially solid.

In some embodiments the fabric roll up core is extruded.

In a third aspect the invention provides a fabric roll up core for carrying a sheet material comprising:

a first fabric roll up core part and a second fabric roll up core part and a connector for joining the first and second fabric roll up core parts together end-to-end to form a fabric roll up core longer than the first or second fabric roll up core parts, wherein the first and second fabric roll up core parts each comprise a profile along a length thereof and the connector comprises a complementary profile along a length thereof, and wherein the wherein the first and second fabric roll up core and the connector have constant cross-section shapes at least at or near connecting ends thereof, so that the connector and the first and second fabric roll up core parts lengthwise fit together to form the longer fabric roll up core.

In some embodiments the complementary profiles of the first and second fabric roll up core parts and connector act to prevent relative rotation between the connector and the first and second fabric roll up core parts such that when rotated both first and second fabric roll up core parts rotate together as one.

In some embodiments the connector comprises a sleeve, into a longitudinally extending interior of which, ends of the first and second fabric roll up core parts fit to join the parts and the sleeve.

In some embodiments the first and second fabric roll up core parts fit into the sleeve so that the sleeve forms a raised diameter portion on the fabric roll up core.

In some embodiments the raised diameter portion of the fabric roll up core comprises the outer circumferential surface of the sleeve being between 2 and 20 mm, 2 and 10 mm, 2 and 8 mm, 2 and 6 mm, 2 and 5 mm, 2.5 and 4 mm, or about 3 mm higher than the outer circumferential surface of the fabric roll up core parts.

In some embodiments the profile extends along the length of the first and second fabric roll up core parts.

In some embodiments the profile is formed in an outer surface of the first and second fabric roll up core parts and a complementary profile is formed in an inner surface of the connector, the connector forming a sleeve for receiving ends of the first and second fabric roll up core parts.

In some embodiments the profile comprises:

at least one rib extending along the length of each of the first and second fabric roll up core parts and a complementary profile of the connector comprises at least one recess extending along the length of the connector for receiving the rib, or at least one recess extending along the length of each of the first and second fabric roll up core parts and a complementary profile of the connector comprises at least one rib extending along the length of connector to be received in the recess.

In some embodiments the profile comprises a plurality of said ribs and/or a plurality of recesses spaced apart circumferentially around the first and second fabric roll up core parts and the complementary profile comprises a plurality of said recesses and/or a plurality of ribs spaced apart circumferentially around the connector.

In some embodiments the first and second fabric roll up core parts each comprise a profile formed in an outer surface of the first and second fabric roll up core parts and the profile assists in maintaining the sheet material on the fabric roll up core, at least when rolling the sheet material onto the fabric roll up core.

In some embodiments the profile comprises a plurality of ribs extending along the length of each of the first and second fabric roll up core parts In some embodiments the profile is unidirectional around a circumference or periphery of the first and second fabric roll up core parts.

In some embodiments the profile comprises a plurality of ribs extending along the length of each of the first and second fabric roll up core parts and the ribs are asymmetric in transverse cross section.

In some embodiments a first side of each rib slopes from an outer circumference of the fabric roll up core towards a centre line of the rib more than an opposite second side of the rib.

In some embodiments the first side slopes towards the centreline of the rib and the second side is approximately aligned radially relative to the centre of the fabric roll up core.

In some embodiments the first side slopes towards the centreline of the rib and the second side is approximately parallel to a radial centreline of the rib.

In some embodiments the first side slopes towards the centreline of the rib and the second side slopes from the outer circumference away from the centre line of the rib.

In some embodiments the at least one rib or ribs have a height of about 2 mm to 10 mm, 2 mm to 8 mm, or 3 mm to 6 mm, or 4 mm to 5 mm.

In some embodiments the fabric roll up core parts have a diameter, or maximum width in transverse cross section, measured across the outer surface of the fabric roll up core parts and including any ribs, of about 20 mm to 200 mm, 40 mm to 150 mm, or 50 mm to 125 mm, or 50 mm to 100 mm, or 50 mm to 90 mm, or 60 mm to 80 mm, or 55 to 65 mm.

In some embodiments the profile comprises about 4 to 30 ribs, or 5 to 25 ribs, or 6 to 20 ribs, or 8 to 18 ribs, or 10 to 16 ribs, or 12 to 14 ribs spaced apart circumferentially around the fabric roll up core parts.

In some embodiments the profile extends along the full length of the fabric roll up core parts.

In some embodiments the complementary profile extends along the full length of the connector.

In some embodiments a wall of each of the first and second fabric roll up cores parts comprises a plurality of radially outwardly stepped portions and a plurality of radially inwardly stepped portions, the outwardly stepped portions and the inwardly stepped portions alternating around the circumference of the first and second fabric roll up core parts, the outwardly stepped portions forming the ribs of the profile extending along the length of the fabric roll up core part, and the inwardly stepped portions forming the recesses of the profile along the length of the fabric roll up core part.

In some embodiments the first and second fabric roll up core parts are hollow.

In some embodiments the fabric roll up core parts abut together at the connector, the fabric roll up core length equal to the combined length of the first and second fabric roll up core parts.

In some embodiments the fabric roll up core parts releasably connect with the connector.

In some embodiments the fabric roll up core parts are hollow and the connector is a dowel to be received in an end of each of the first and second fabric roll up core parts.

In some embodiments the dowel is hollow.

In some embodiments the dowel is solid.

In some embodiments the fabric roll up core parts are extruded.

In some embodiments the connector is extruded.

In some embodiments each of said first and second parts engage with the connector via a clearance fit.

In some embodiments each of said first and second parts engage with the connector via a transition or interference fit (including press fit or friction fit).

In some embodiments the connector and first and/or second parts can be assembled through application of a force of between about 3N and 140N, or between about 10 and 140N, or between about 10N and 125N, or between about 50N and 120N, or between about 80N and 110N, said force applied along the longitudinal axis of the fabric roll up core and in a direction to assemble the parts.

In some embodiments the connector and first and/or second parts can be disassembled through application of a force of between about 3N and 140N, or between about 10 and 140N, or between about 10N and 125N, or between about 50N and 120N, or between about 80N and 110N, said force applied along the longitudinal axis of the fabric roll up core and in a direction to separate the parts.

In some embodiments any friction that needs to be overcome to either assemble and/or disassemble the connector and first and/or second fabric roll up core parts can be overcome by hand and without mechanical assistance.

In some embodiments, when assembled, a gap of, on average, 0.10 to 4.0 mm, or 0.15 to 3.0 mm, or 0.15 to 0.25 mm, or 0.15 to 2.0 mm, or 0.15 to 1.0 mm exists between the opposing faces of either the first and second fabric roll up core parts and said connection.

In some embodiments each of said first and second fabric roll up core parts are between 0.8 and 4 m, or 1 and 3.5 m, or 1 and 3 m, or 1.0 to 2.0 m, or 1.8 to 2.2 m, or 1.5 and 2.5 m, or 2.5 and 3.5 m, or 2.8 and 3.2 m long.

In some embodiments, on the surface of the first and/or second fabric roll up core parts which oppose an opposing surface of the connector, at least one protrusion is located, said at least one protrusion arranged such that it increases frictional engagement between said first and/or second fabric roll up core parts and the connector.

In some embodiments, on the surface of the connector which opposes an opposing surface of the first and/or second fabric roll up core parts, a protrusion is located, said protrusion arranged such that it increases frictional engagement between said first and/or second fabric roll up core parts and the connector.

In some embodiments the protrusion comprises either a rib, or a series of bumps or raised portions, running along at least part of the length of said first and/or second fabric roll up core parts.

In some embodiments the protrusion comprises either a rib, or a series of bumps or raised portions, running along at least part of the length of said connector.

In some embodiments the said first and second fabric roll up core parts are the same length.

In some embodiments the connector is between about 20 cm and 2 m, or about 30 cm and 1.8 m, or about 30 cm and 1.5 m, or about 30 cm and 1.2 m, or about 30 cm and 1 m, or about 30 cm and 0.8 m, or about 30 cm and 50 cm, or about 0.8 to 1.2 m long.

In some embodiments the fabric roll up core is generally circular in cross-sectional profile.

In some embodiments the fabric roll up core is generally square or rectangular in cross-sectional profile.

In some embodiments the fabric roll up core comprises one or more parts and at least one of said parts comprise two or more annular layers when viewed in cross-section.

In some embodiments the fabric roll up core comprises one or more parts, at least one of said parts comprising three annular layers when viewed in cross-section.

In some embodiments the fabric roll up core comprises the middle layer of the three annular layers comprises glass reinforcement.

In a fourth aspect the invention provides a kit of parts for forming a fabric roll up core comprising the first fabric roll up core part, the second fabric roll up core part and the connector as defined in the third aspect of the invention.

In a fifth aspect the invention provides a method for configuring a sheet material for storage or transportation comprising:

providing a first fabric roll up core part and a second fabric roll up core part and a connector for joining the first and second fabric roll up core parts together end to end, joining the first and second fabric roll up core parts together end-to-end by the connector to form a fabric roll up core having a length approximately the sum of the length of the first and second fabric roll up core parts, rolling the sheet material onto the fabric roll up core with a longitudinal direction of the sheet material approximately perpendicular to a longitudinal axis of the fabric roll up core until the sheet material forms a roll of material on the fabric roll up core, and transporting or storing the roll of material for future deployment, the sheet material to be deployed by unrolling the sheet material from the fabric roll up core.

In some embodiments the connector is a sleeve and the method comprises fitting an end of the first fabric roll up core part into one end of the sleeve and an end of the second fabric roll up core part into an opposite end of the sleeve so that the sleeve forms a raised diameter portion on the fabric roll up core, and rolling the sheet material onto the fabric roll up core so that the sheet material forms a roll of material on the fabric roll up core comprising a raised part corresponding with the sleeve.

In a sixth aspect the invention provides a method of winding a length of sheet material onto a fabric roll up core comprising engaging a rotating drive means to the fabric roll up core of the first aspect of the invention, or to either of the first or second fabric roll up core parts of the fabric roll up core of the second aspect of the invention, such that the drive means and the fabric roll up core may rotate as one, and causing said rotating drive means to rotate, thereby causing the fabric roll up core to rotate, so that the sheet material becomes wound onto said fabric roll up core.

In some embodiments the rotating drive means is engaged to said fabric roll up core by:

(i) locating a locking pin through a hole or recess in said fabric roll up core, said locking pin also either extending from or at least part way through said rotating drive means, or (ii) a means that clamps onto an inner circumferential surface and an outer circumferential surface of said fabric roll up core, or (iii) a means that clamps onto the outer circumferential surface of the fabric roll up core, but not the inner circumferential surface.

In some embodiments the rotating drive means and fabric roll up core comprise complimentary profiles, said complimentary profiles able to engage such that said drive means and fabric roll up core are fixed such that they rotate as one, thereby enabling said fabric roll up core to be rotationally driven.

In some embodiments the complimentary profiles comprise the inner surface of a hollow, or partially hollow, drive means and that inner surface engages with a complimentary outer surface of the fabric roll up core.

In some embodiments the complimentary profiles comprise the outer surface of the drive means and that outer surface engages with a complimentary inner surface of the fabric roll up core.

The embodiments described herein may relate to any of the aspects described herein, as appropriate.

The term "fabric roll up core" as used herein means a shaft or a spindle for carrying a roll of sheet material for use in agriculture or horticulture, having a length of at least 0.5 m, or at least 0.75 m, or at least 1 m or at least 1.5 m or at least 2.0 m long, and a diameter of at least 20 mm, or at least 40 mm, or at least 50 mm.

The term "circumferential" as used herein is not limited to circumferences of fabric roll up cores that are circular in transverse cross section and includes other non-circular circumferential shapes. More specifically, the term is also used with reference to profiles that are square or rectangular in transverse cross section, and those that form an incomplete circle or square (such as a "C" shape), as well as other shapes.

The term "unidirectional" as used herein with reference to a transverse cross-sectional profile of a fabric roll up core means that the profile of the fabric roll up core will operate more effectively when the fabric roll up core is rotated in one direction than when rotated in the other, e.g. having ribs that are asymmetric in cross-sectional shape.

The term "sheet material" as used herein includes netting materials, in particular horticultural netting materials.

The term "comprising" as used herein means "consisting at least in part of". When interpreting each statement in this specification and claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention is further described by way of example with reference to the accompanying drawings in which.

For the purpose of more clearly illustrating the invention, the fabric roll up cores, or fabric roll up core parts, illustrated in perspective in the above figures have illustrated shorter than they would be in some preferred embodiments.

DETAILED DESCRIPTION OF EMBODIMENTS

A fabric roll up core according to some embodiments of the present invention is described below with reference to FIGS. 1 to 13.

Figure 1:
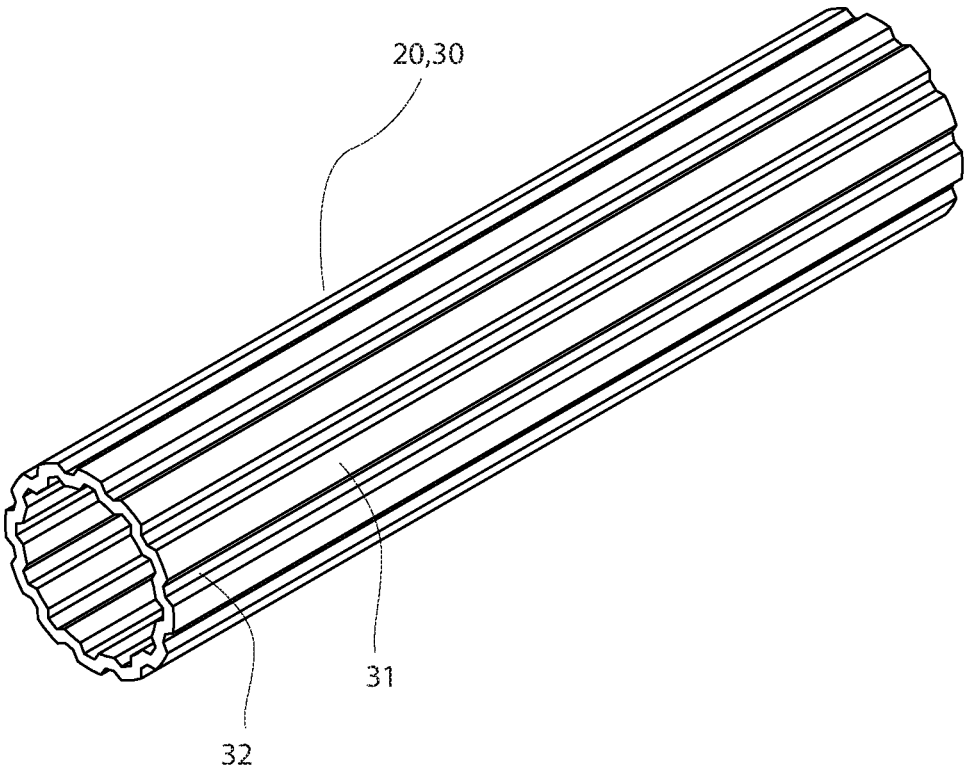
FIG. 1 is perspective view of a fabric roll up core part, which when connected to a similar fabric roll up core part can be used for carrying sheet material, according to an embodiment of the present invention; or can be used on its own as a single part fabric roll up core, according to another embodiment of the invention.
Figure 3A:
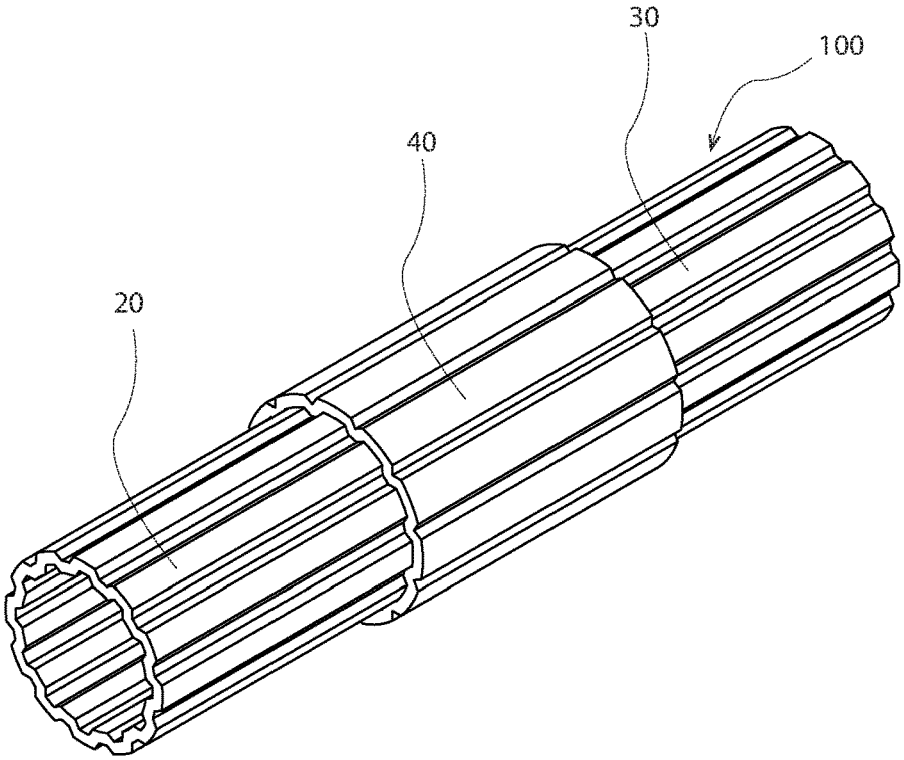
FIG. 3A is a perspective view of the fabric roll up core part of FIG. 1 joined end-to-end with a similar fabric roll up core part by a connector, in this case a sleeve.

In some embodiments the fabric roll up core comprises a first fabric roll up core part and a second fabric roll up core part and a connector for joining the first and second fabric roll up core parts together end-to-end. An example fabric roll up core 100 is illustrated in FIG. 3A. Fabric roll up core 100 comprises a first fabric roll up core part 20 and a second fabric roll up core part 30, joined together by a connector 40. FIG. 1 illustrates a fabric roll up core part 20, 30.

For example, in some embodiments the fabric roll up core parts may be about 2 m long and the assembled fabric roll up core about 4 m long. By providing the fabric roll up core in two fabric roll up core parts, the fabric roll up core parts are more easily stored and transported compared to a full length fabric roll up core. Essentially, two short cores may be stored and transported, and then conveniently joined when they are required for use. For example, 2 m fabric roll up core parts may be loaded onto a pallet for transportation or storage whereas a 4 m long fabric roll up core cannot due to its length. Once the fabric roll up core is required a user may assemble the fabric roll up core parts together with the connector. Accordingly, the present invention may provide the advantage of storing and transporting the fabric roll up core as relatively short components ready for convenient assembly at the point of use. In some embodiments the first and second fabric roll up core parts are identical.

In some embodiments no connector is used and the fabric roll up core is provided as a single piece. In some embodiments, such a fabric roll up core may be about 4 m long.

In some embodiments as illustrated in FIG. 3A, the connector is a sleeve and an end of each fabric roll up core part 20, 30 may be pushed into the connector 40. Ends of the fabric roll up core parts slide into the sleeve 40 so that the sleeve forms a raised diameter portion on the fabric roll up core. In some embodiments, when assembled, the outer circumferential surface of the sleeve is raised approximately 3 mm or more, or in some cases about 6 mm or more, or in some cases about 9 mm or more, from the outer circumferential surface of the fabric roll up core parts. In some embodiments, the fabric roll up core parts are the same length and fit into the sleeve so that the sleeve forms a central raised diameter portion on the fabric roll up core. This embodiment of the present invention may be particularly useful as the raised diameter portion provided by the connector 40 may help the sheet material to track centrally onto the fabric roll up core when rolling the sheet material onto the fabric roll up core. The raised diameter portion formed by the connector may assist with tracking the sheet material onto the fabric roll up core in a similar way to the way in which the camber of a cambered roller maintains a sheet material centrally on the roller. The sleeve connector may form a raised portion in a roll of sheet material on the fabric roll up core. For example, in FIG. 5 the illustrated roll of sheet material 10 has a raised part 80 corresponding with the sleeve connector 40 of the fabric roll up core 100 illustrated in FIG. 3A.

Figure 3B:
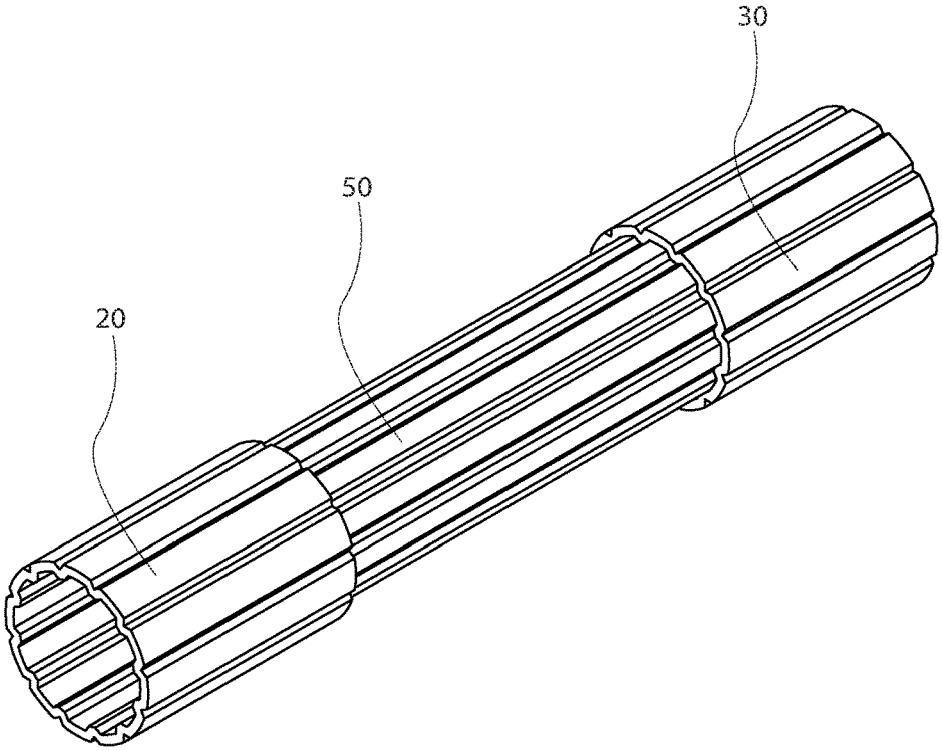
FIG. 3B is a perspective view of a fabric roll up core of an alternative embodiment joined by a dowel. The fabric roll up core is shown with the fabric roll up core parts spaced apart for purposes of illustrating the dowel, but generally in use the fabric roll up core parts would be pushed together so that they abut each other end-to-end.

In some embodiments, and as illustrated in FIG. 3B, the connector is a dowel 50 to be received in an end of each of the first and second fabric roll up core parts. In FIG. 3B, the fabric roll up core parts are shown spaced apart so that the dowel may be illustrated, but preferably in use the fabric roll up core parts abut each other end-to-end. In some embodiments the fabric roll up core parts 20, 30 are hollow, and the dowel connector 50 is received in an end of each of the fabric roll up core parts to connect the fabric roll up core parts together. In some embodiments the dowel is hollow. In some embodiments the dowel has a solid cross section (is not hollow) or it has a thicker wall section to add to the rigidity between the two joined fabric roll up cores.

In some embodiments, the first and second fabric roll up core parts are of different lengths. This may provide the option of forming different length fabric roll up cores from relatively few standard length fabric roll up core parts. For example, two different standard length fabric roll up core parts, say 2 m and 3 m, can be used to form an assembled fabric roll up core of length 4 m, 5 m or 6 m, depending on which two standard parts are selected. More than two fabric roll up core parts can also be connected for further length options.

Figure 2:
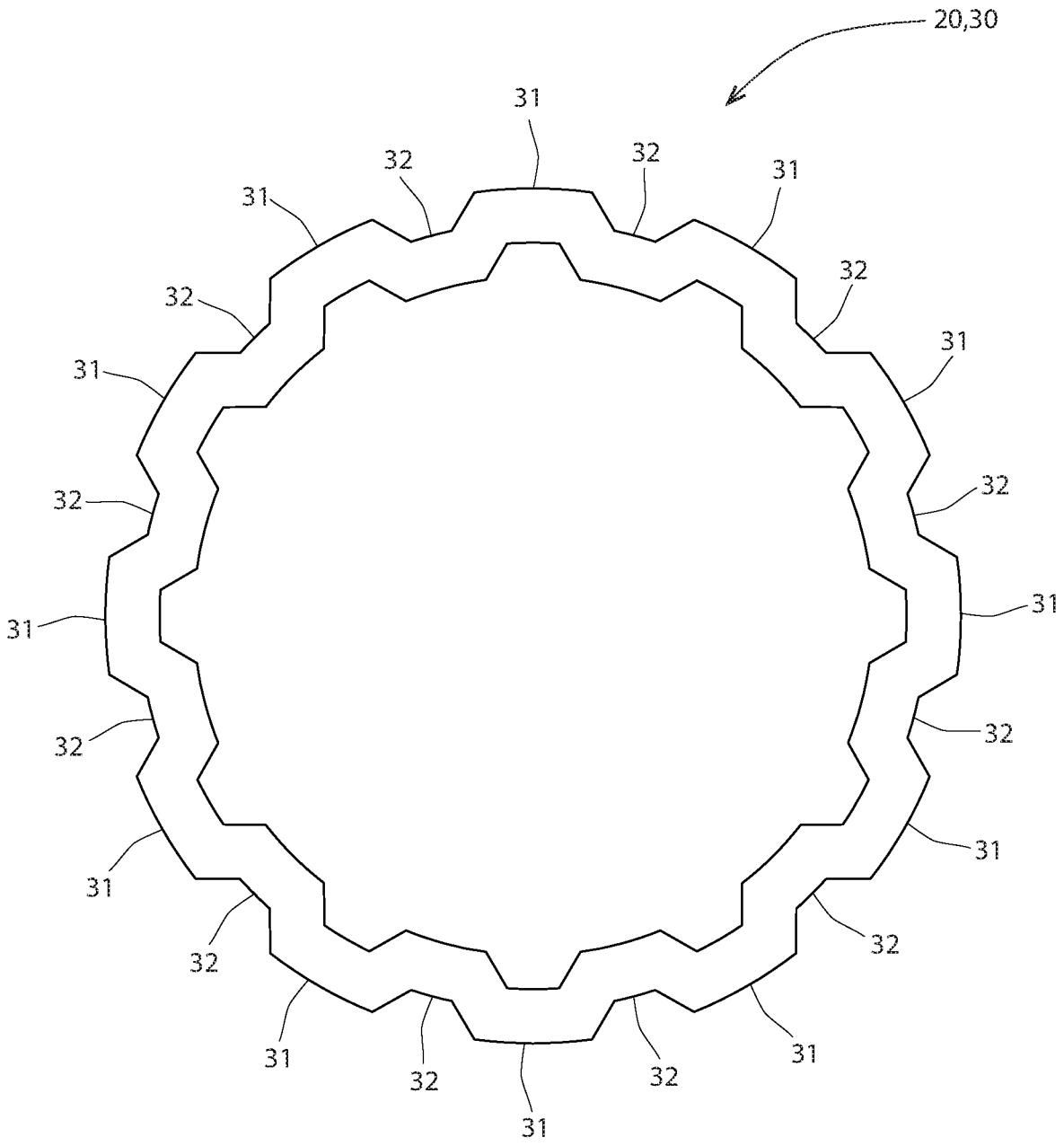
FIG. 2 is cross sectional view of the fabric roll up core part shown in FIG. 1.

In some embodiments the first and second fabric roll up core parts each comprise a profile and the connector comprises a complementary profile so that the connector fits together with the first and second fabric roll up core parts to prevent relative rotation between the connector and the first and second fabric roll up core parts. The profile may be generally circular with at least one irregularity, e.g. a rib, in that circular shape. For example, as shown in FIGS. 1 and 2, the fabric roll up core parts comprise at least one rib 31 extending along the length of the fabric roll up core part and the connector comprises at least one recess for receiving the rib. The rib of the fabric roll up core part received in the connector rotationally locks the fabric roll up core part to the connector so there is no relative rotation between the fabric roll up core part and connector.

By contrast, if the profile of the fabric roll up core and connector are both smooth such that the fabric roll up core parts and connector can rotate relative to each other, when a rotating drive means or shaft (such as a power from a hydraulic motor driven by tractor hydraulics or the power takeoff on a tractor) is connected to one of the fabric roll up core parts, the fabric roll up core part to which the rotating drive means is connected may, due to slippage, rotate differently to the connector and other fabric roll up core part. This may be problematic in achieving consistent rolling of material onto the fabric roll up core.

Figure 13:
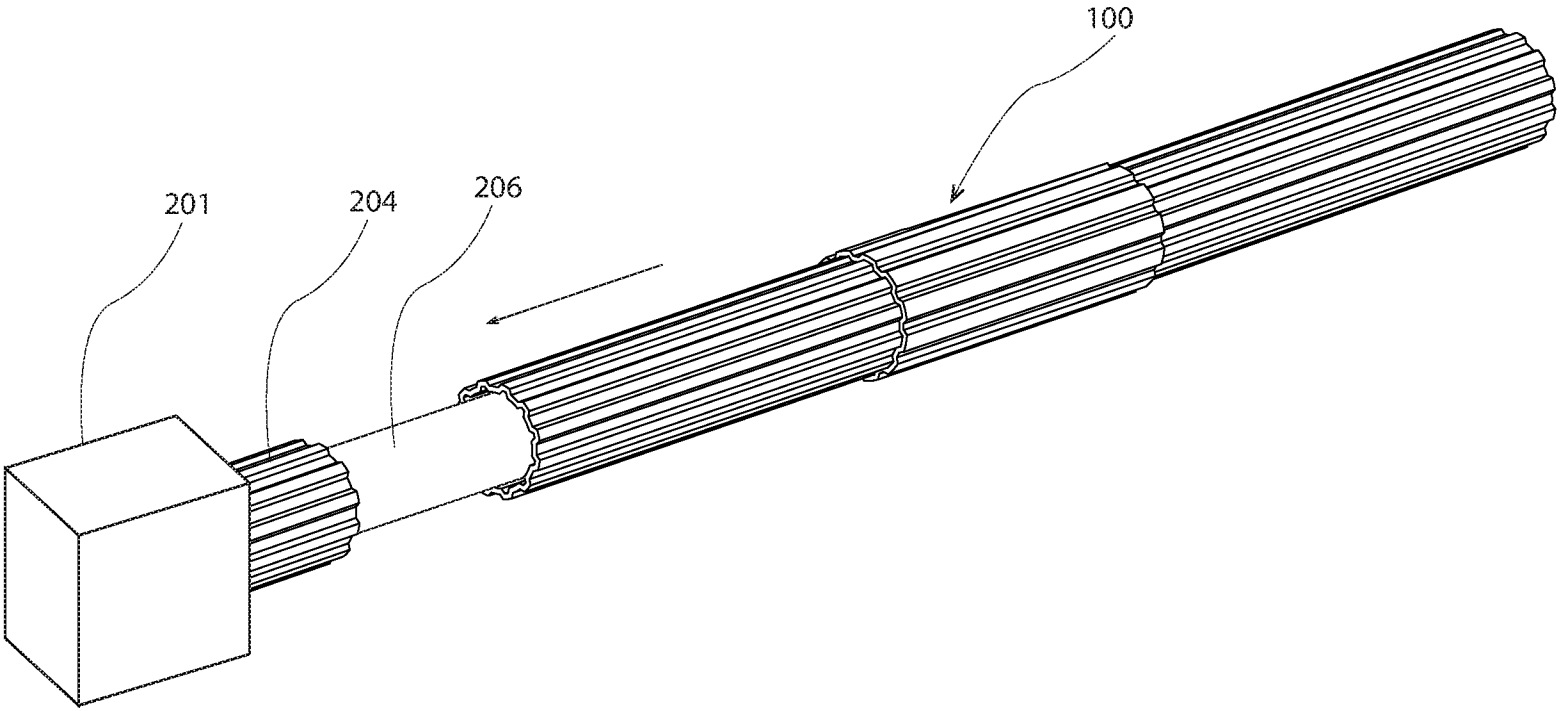
FIG. 13 is a schematic illustration of a rotating drive means about to be engaged with a fabric roll up core of one embodiment of the invention.

In some embodiments, the rotating drive means or shaft may be the connector itself; either in the form of a sleeve or a dowel. More specifically, the connector may at one end be attached to a rotating drive means (e.g. a rotating drive means or drive shaft driven by a hydraulics on a tractor) through use of a locking pin, leaving the other end free to engage and rotate a fabric roll up core. For a sleeve connector used in this manner, the fabric roll up core would be located inside the sleeve in order to effect rotation. Such an embodiment is illustrated in FIG. 13, which is described in further detail later. In the case of a dowel connector, the fabric roll up core would be located such that the dowel was inserted inside the fabric roll up core.

In the illustrated embodiment the fabric roll up core parts comprise a plurality of ribs 31 spaced apart around the circumference of the fabric roll up core part, each rib separated from an adjacent rib by a recess 32. The ribs and recesses may be described as ridges and troughs, spaced around the circumference of the fabric roll up core part. The ribs may assist in adding rigidity to the fabric roll up core. The ribs may also assist in allowing the parts of a multi-part mandrel to be joined efficiently.

In some embodiments the fabric roll up core or roll up core part will bend less than 40 cm, or less than 38 cm, or less than 36 cm, or less than 35 cm, or less than 34 cm, or less than 32 cm, or less than 30 cm, when a 1.5 m length of the fabric roll up core, or a 1.5 m length of a first part or second part of a fabric roll up core of a multi-part fabric roll up core, has a down force of 200N applied half way along its length. More specifically, amount of bend may be determined by fixing a fabric roll up core, or fabric roll up core part, such that it is horizontal and 1.5 m of the fabric roll up core, or fabric roll up core part, is free to bend, with the remainder held straight. Amount of bend can then be determined by measuring the vertical movement of the free end of the fabric roll up core when a down force of 200N is applied halfway along the 1.5 m free portion of the fabric roll up core. The temperature of the fabric roll up core should be 28° C. for these readings.

Figure 4A:
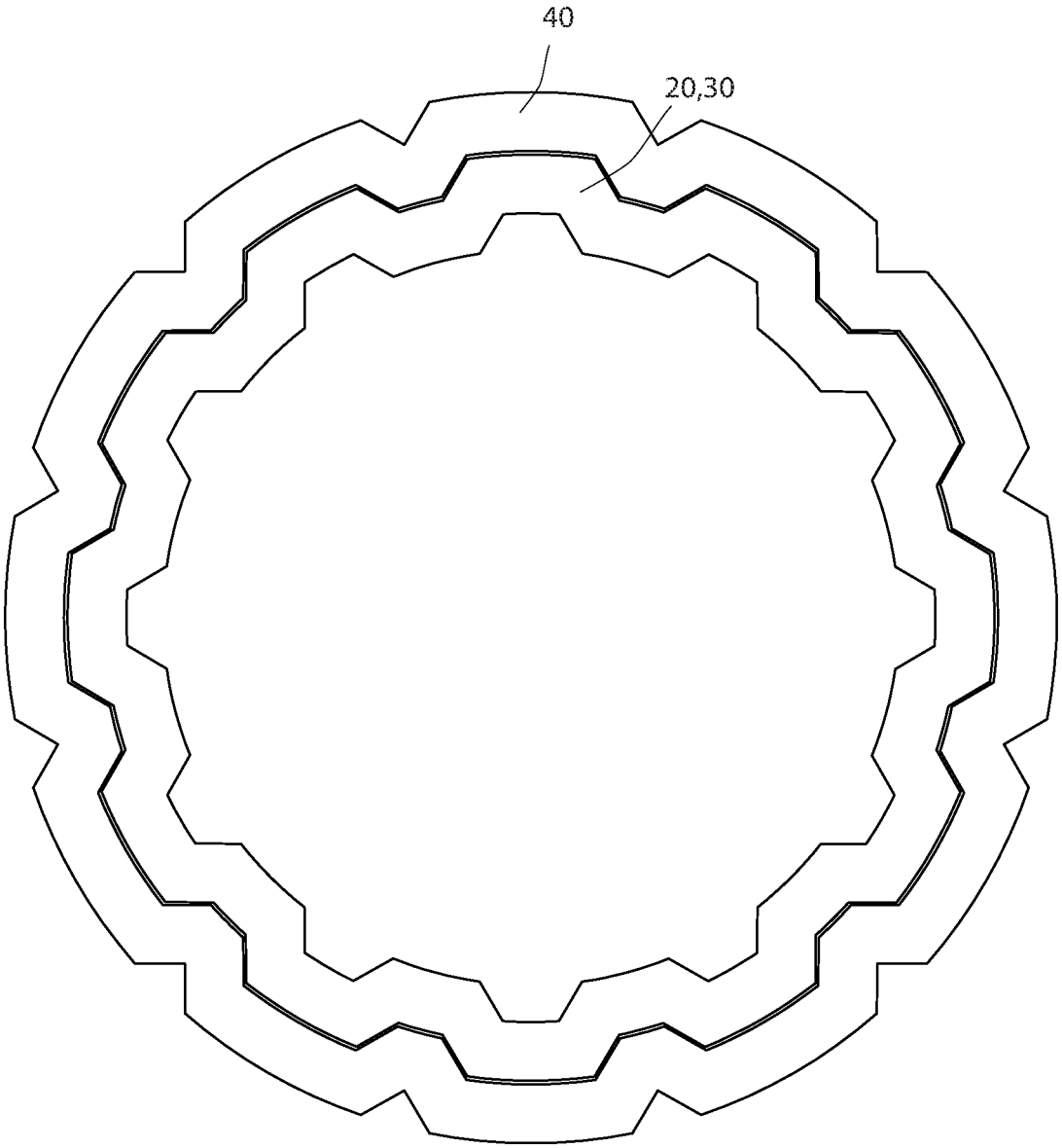
FIG. 4A is a cross sectional view of the fabric roll up core and connector illustrated in FIG. 3A.
Figure 4B:
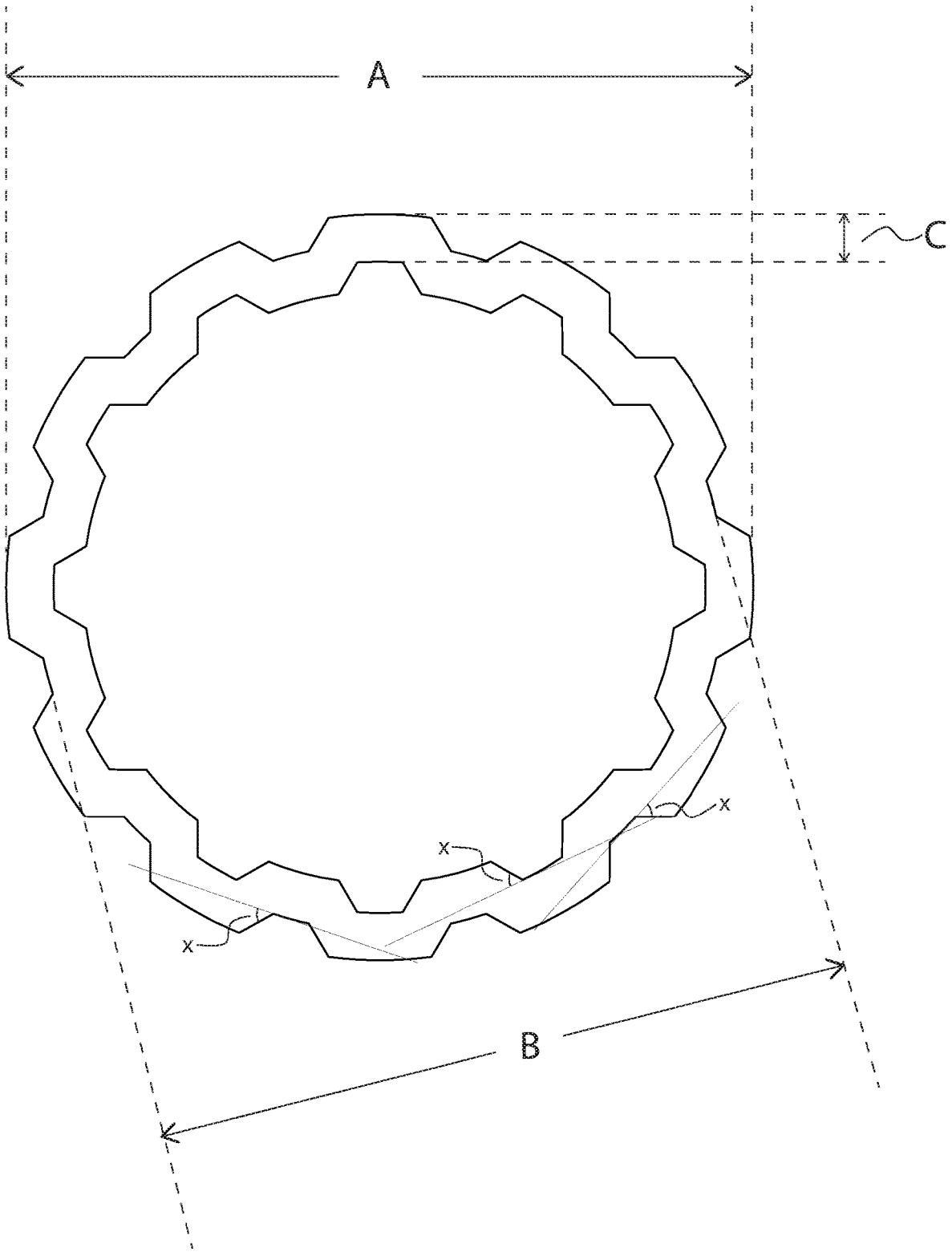
FIG. 4B is a cross sectional view of the fabric roll up core illustrated in FIG. 3A, illustrated without the connector.
Figure 4C:
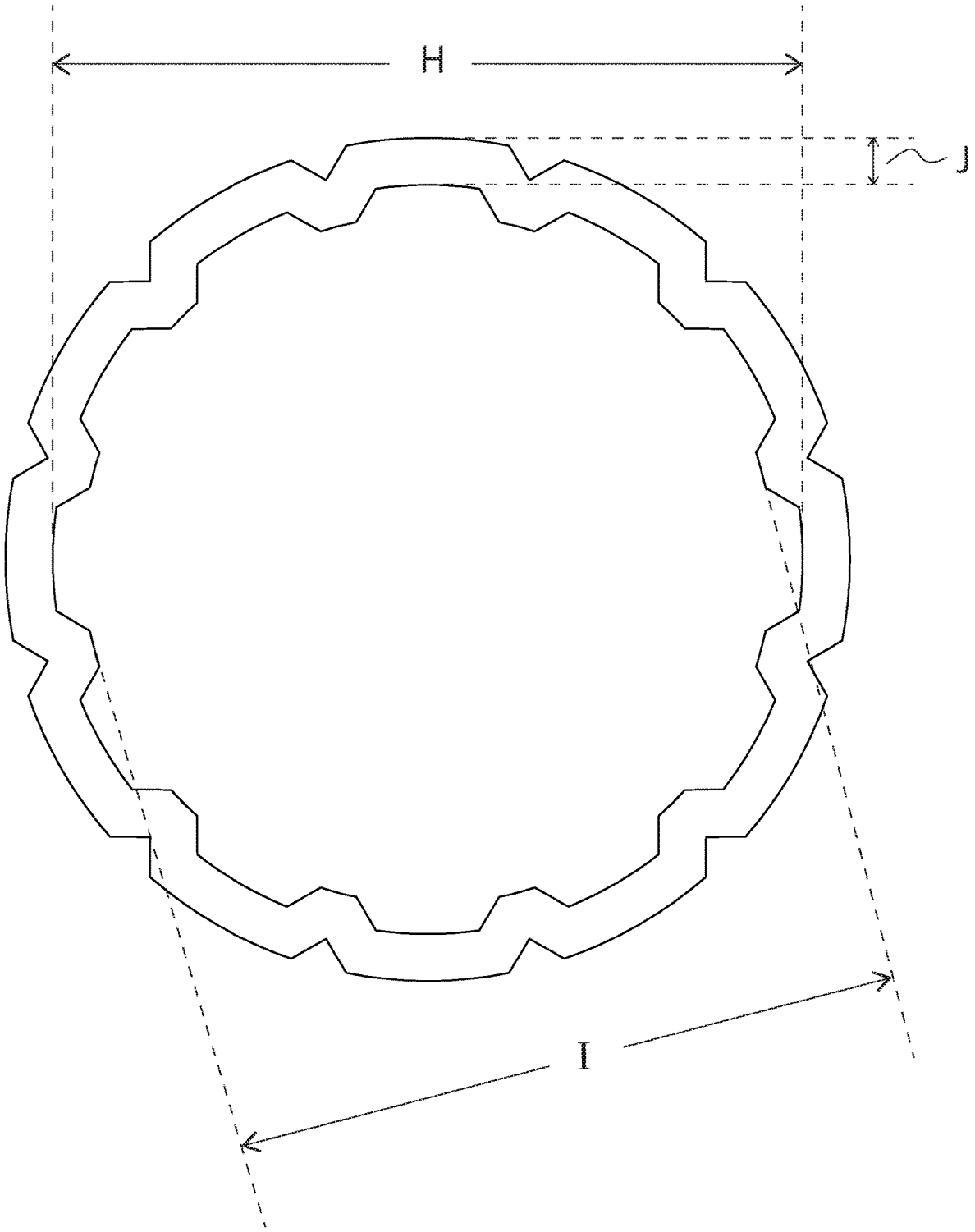
FIG. 4C is a cross sectional view of the connector illustrated in FIG. 3A, illustrated without the fabric roll up core.
Figure 5:
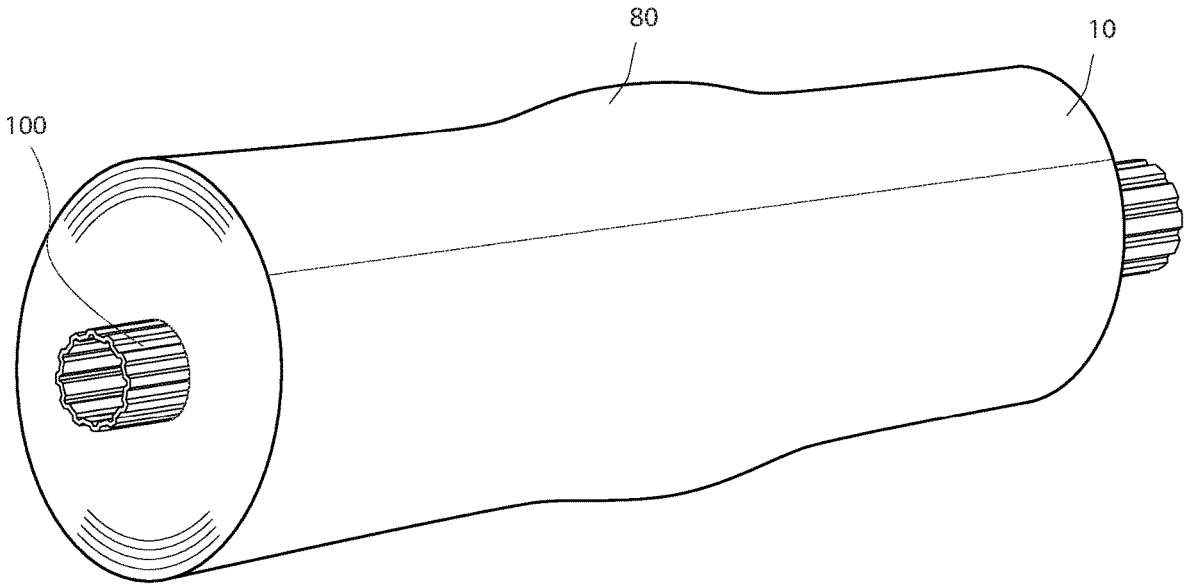
FIG. 5 is a perspective view showing a sheet material rolled onto the fabric roll up core of FIG. 3A.

In the embodiment illustrated in FIG. 3A, the first and second fabric roll up core parts have a diameter measured across the outer surface (distance A on FIG. 4B) of the ribs of 63 mm and across the outer circumferential surface of the troughs of about 58 mm (distance B on FIG. 4B). The wall (distance C on FIG. 4B) of the fabric roll up core is 4 mm thick in cross section. The outer circumferential surface of each rib is about 2.5 mm above the outer circumferential surface of each trough. The walls of each rib protrude from the surface of the fabric roll up core (or more specifically, from the base of the trough) at an angle of about 60°. The connector has a diameter measured across the inner circumferential surface (distance H on FIG. 4C) of the ribs of about 63.5 mm and across the inner circumferential surface of the troughs of about 58.5 mm (distance I on FIG. 4C). The wall (distance J on FIG. 4C) of the connector is 4 mm thick in cross section. The outer circumferential surface of each rib is also about 2.45 mm above the outer circumferential surface of each trough. This arrangement provides an average clearance around the fabric roll up core of about 0.25 mm between the outer circumferential surface of the fabric roll up core parts and the inner circumferential surface of the connector, when they are engaged. This small clearance enables the parts to be pushed together but it requires an amount of force, this locks the three parts together.

In some embodiments above, the connector and fabric roll up core parts would separate under a force of 100N (N being newton). In some embodiments the amount of force required is that which can be provided by hand, and without mechanical assistance. In some embodiments the amount of force required is between about 3N and about 140N, applied along the longitudinal axis of the fabric roll up core. In other embodiments the amount of force required is between about 10 and 140N, or between 10N and 125N, or between about 50N and 120N, or between about 80N and 110N. The profile of the fabric roll up core with a corrugated surface gives increased surface area which assists in the locking of the three parts together. The parts are locked together sufficiently firmly to stop them falling apart when in use, but not so firm that that they cannot be disassembled by hand for disassembly for the purpose of storing or transporting the fabric roll up core. The illustrated embodiment is an extruded product, and the above measurements are based on the finished product. Both the first and second fabric roll up core parts, and the connector, were made of polypropylene.

In some embodiments as illustrated in FIG. 1 and FIG. 2, the fabric roll up core parts are hollow and the ribs and recesses on the outside of a circumferential wall of the fabric roll up core part correspond with recesses and ribs on an inside of the circumferential wall of the fabric roll up core part. That is the circumferential wall of the first and second fabric roll up cores parts in some embodiments comprises a plurality of radially outwardly stepped portions 31 and a plurality of radially inwardly stepped portions 32, the outwardly stepped portions and the inwardly stepped portions alternating around the circumference of the first and second fabric roll up core parts. The outwardly stepped portions form ribs extending along the length of the fabric roll up core part and the inwardly stepped portions form recesses along the length of the fabric roll up core part.

As illustrated in FIG. 4A which is a cross sectional view through the fabric roll up core connector 40 and one of the first and second fabric roll up core parts 20, 30, the ridges and troughs of the fabric roll up core part fit into corresponding ridges and troughs formed in the connector 40 to rotationally lock the fabric roll up core parts to the connector. In this illustrated embodiment, the profile of the outer surface of the fabric roll up core part matches the complementary profile in the inner surface of the connector. Where the connector is a dowel that fits into an end of each fabric roll up core part, a profile of an inner surface of each fabric roll up core part matches a complementary profile in the outer surface of the dowel connector.

In some embodiments the profile of the fabric roll up core parts that interface with the connector extend the full length of the fabric roll up core parts, so that either end of each fabric roll up core part can fit with the connector. Furthermore, a fabric roll up core can be built from more than two fabric roll up core parts. For example, two connectors could be used to join together three fabric roll up core parts.

In some embodiments the complementary profile of the connector extends the full length of the connector so that ends of the first and second fabric roll up core butt together at the connector. In such an embodiment the fabric roll up core length is equal to the combined length of the first and second fabric roll up core parts.

In some embodiments the fabric roll up core parts releasably connect with the connector so that once a sheet material has been rolled out from the fabric roll up core, the fabric roll up core may be disassembled into the component parts of at least two fabric roll up core parts and a connector for ease of storage and transportation. The parts may be reassembled again for future use. Once reassembled, a sheet material can be rolled onto the fabric roll up core for storage and future deployment.

In some embodiments the fabric roll up core parts 20, 30 fit to the connector 40 in a clearance fit, for example a sliding fit, so that the fabric roll up core parts can be assembled and disassembled to and from the connector with relative ease. The gap between the opposing faces of the fabric roll up core and connector, when assembled, may be about 0.6 mm. A gap of such a size allows the parts to be readily assembled together, but is small enough such that, unless the parts are perfectly aligned, there is a small amount of resistance to the parts disengaging, thereby helping the parts remain engaged during use. In some embodiments the fabric roll up core parts 20, 30 fit to the connector 40 in a transition fit, or an interference fit, or a press fit, or a friction fit, so that the fabric roll up core parts are fitted tightly to the connector but can still be separated by hand. A gap of about 0.4 mm or less between the opposing faces of the fabric roll up core and connector, when assembled, may be required for such a fit.

In some embodiments, and with reference to FIGS. 1 to 7, the fabric roll up core is of a generally circular profile in transverse cross section. In some embodiments, and with reference to FIG. 8 the fabric roll up core is of generally square profile in transverse cross section.

In some embodiments, the profile, when viewed in transverse cross section, comprises a plurality of troughs in the outer surface alternating with a plurality of troughs in the inner surface, the troughs on outer and inner surfaces all having a substantially similar cross sectional profile. In some embodiments, the troughs have a flat bottom section, and the width of the bottom section of the troughs on the outer surface is similar to the width of the bottom section of the troughs on the inner surface.

In some embodiments, the rib(s) may be a symmetrical in transverse cross-sectional profile. In other embodiments the rib(s) may be asymmetrical in transverse cross-sectional profile.

Figure 3C:
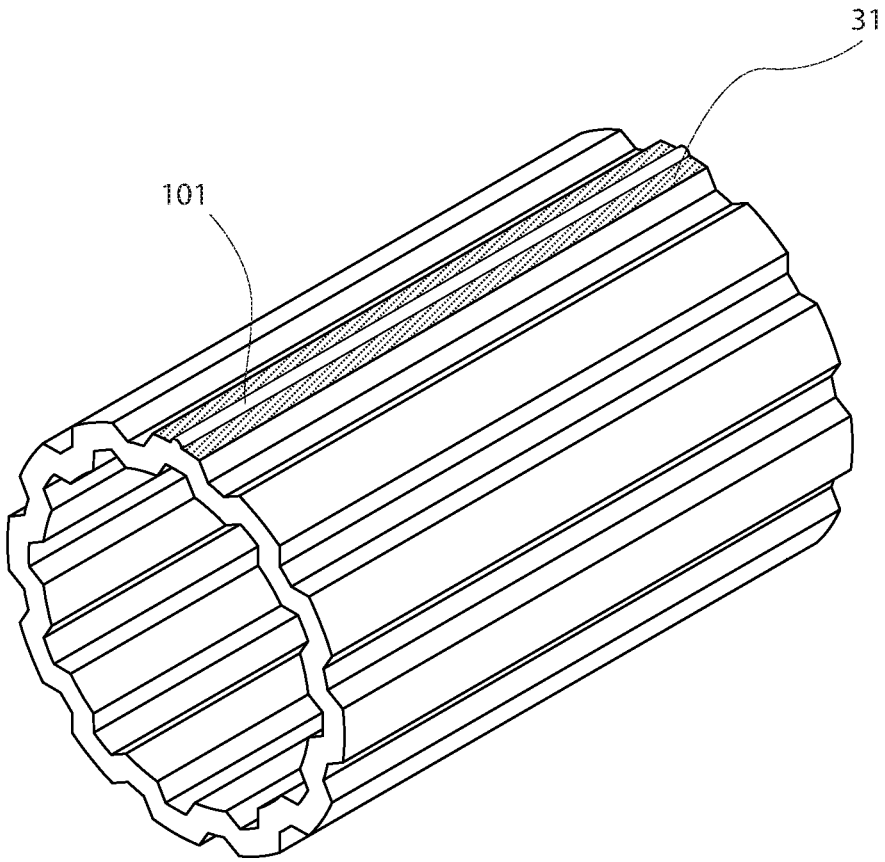
FIG. 3C is a perspective view of a fabric roll up core part of an alternative embodiment where the fabric roll up core parts are connected with a sleeve.
Figure 3D:
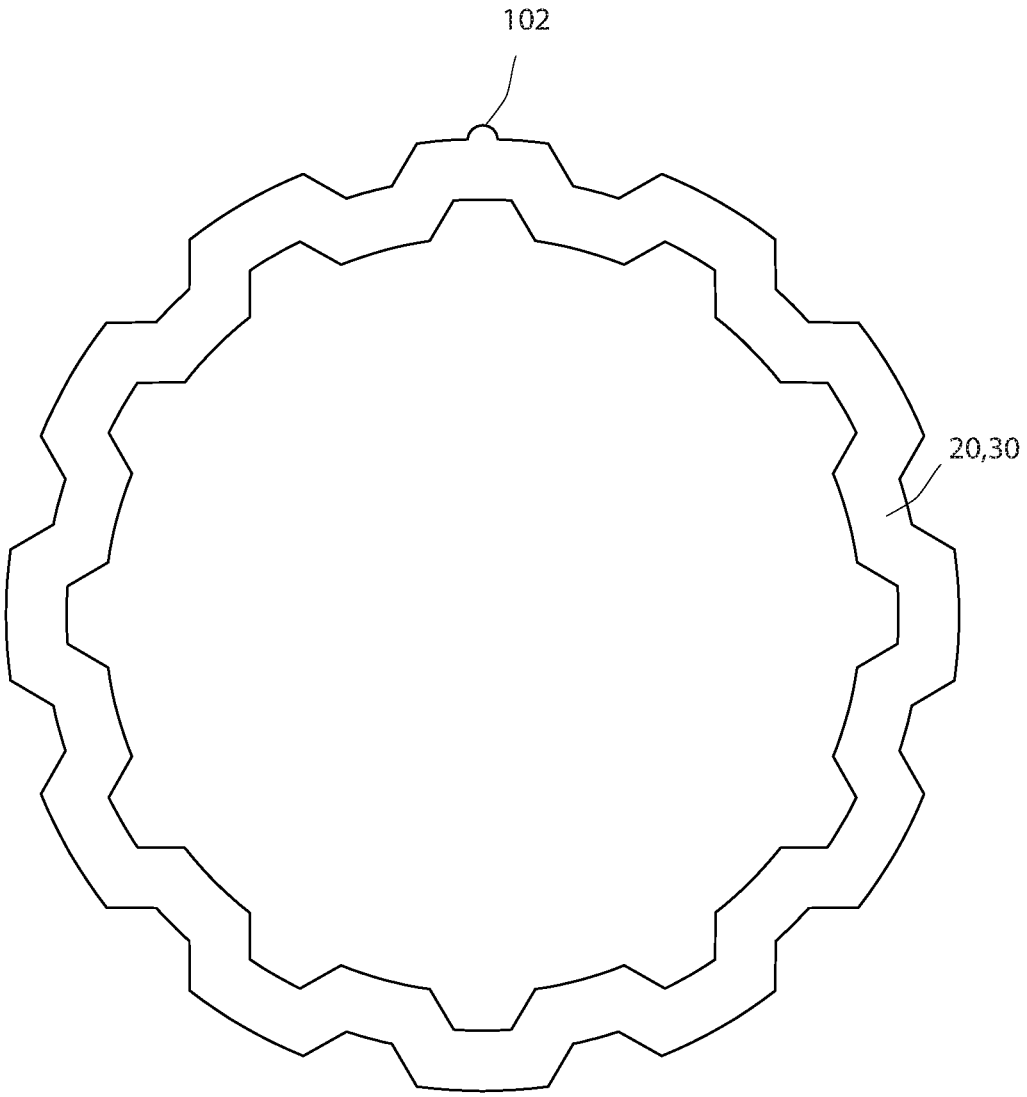
FIG. 3D is a cross sectional view of the fabric roll up core part illustrated in FIG. 3C.

With reference to FIG. 3C, in some embodiments a protrusion (101) is located on one of the opposing surfaces of the first and/or second fabric roll up core parts and the connector. The protrusion may be a simple bump or raised portion in the surface, or it may be a rib or series of bumps or raised portions extending either in part or fully along the length of the surface, or it may be a rib or series of bumps extending circumferentially around the surface, either in part or fully around the surface. In FIG. 3C, the protrusion (101) forms a small rib extending along the length of one of the ribs (31) of the fabric roll up core part. The top surface of the rib (31) in FIG. 3C has been shaded for the purposes of clearly illustrating the protrusion (101). The protrusion is large enough to engage and increase friction with the opposing surface. In some embodiments there is only one of such protrusions. Other embodiments may comprise multiple protrusions.

In some embodiments the fabric roll up core parts may be formed by extruding, for example extruding from a plastics material. In some embodiments the connector may be extruded, for example, from plastics. In some embodiments the fabric roll up core parts and the connector are formed from any suitable polyolefin such as polyethylene or polypropylene, for example, or a mixture thereof, or an ethylene alpha-olefin, or a polyester, or a polybutylene terephthalate (PBT), or a polycarbonate (PC), or a biopolymer, or a blend of any of the foregoing. The fabric roll up core parts can also be made from polyamide (e.g. nylon) or polyvinylchloride (PVC), polyesters, and polystyrene, styrene-butadiene (SB), acrylonitrile-butadiene-styrene (ABS), styrene-acrylonitrile (SAN), polyethylene terephthalate (PET), polymethylmethacrylate (PMMA), or polyvinylchloride (PVC).

In some embodiments a profile on an outer surface of the fabric roll up core parts assist in maintaining the sheet material on the fabric roll up core, at least when rolling the sheet material onto the fabric roll up core. For example, the profile of the outer surface of the fabric roll up core parts may be adapted to grip or 'grab' the sheet material on the fabric roll up core or prevent or reduce slip between the sheet material and the fabric roll up core. Such gripping may be particularly beneficial when the material has already been wound once around the fabric roll up core; more specifically, after being wound once around the fabric roll up core, from a cross sectional view point, the profile in the outer surface of the fabric roll up core may shape the surface of the otherwise flat wound material into an irregular surface shape (i.e. as it conforms to the surface of the fabric roll up core) which assists in holding subsequent revolutions or material.

In some embodiments, at least one side of a rib 31 may be directed to grab or catch the sheet material. For example with reference to FIG. 6, at least one side 34 of the rib 31 may be approximately aligned radially relative to the centre of the cross section of the fabric roll up core. In the illustrated example of FIG. 6 side 34 of each rib is approximately parallel to a radial centreline 36 of the rib. In another example, as illustrated in FIG. 7, at least one side 37 may slope from the circumference 35 away from the centre line of the rib. In some embodiments, the profile is unidirectional around a circumference of the first and second fabric roll up core parts. In one direction of rotation the fabric roll up core profile may be better adapted to prevent slipping between the sheet material and the fabric roll up core than the opposite direction of rotation. For example, with reference to FIG. 6 the longitudinal ribs are asymmetric; one side 33 of the rib slopes from an outer circumference 35 of the fabric roll up core towards a centre line 36 of the rib more than the opposite other side 34 of the rib 31. For example, one side 33 may slope towards the centreline of the rib and the other side 34 may be approximately aligned radially relative to the centre of the cross section of the fabric roll up core. In the illustrated example of FIG. 6 the second side 34 is approximately parallel to a radial centreline 36 of the rib. In another example, as illustrated in FIG. 7, one side 33 may slope towards the centreline of the rib and the other side 37 may slope from the circumference 35 away from the centre line of the rib. The ribs may be particularly useful in assisting with holding a netting material on the fabric roll up core, at least when rolling the netting material onto the fabric roll up core, either by hand or through use of a machine.

In some embodiments, the fabric roll up core may comprise a coating, or an additional material, applied to the outer circumferential surface of at least the ribs to increase the ability of the fabric roll up core to grip a sheet material.

Figure 6:
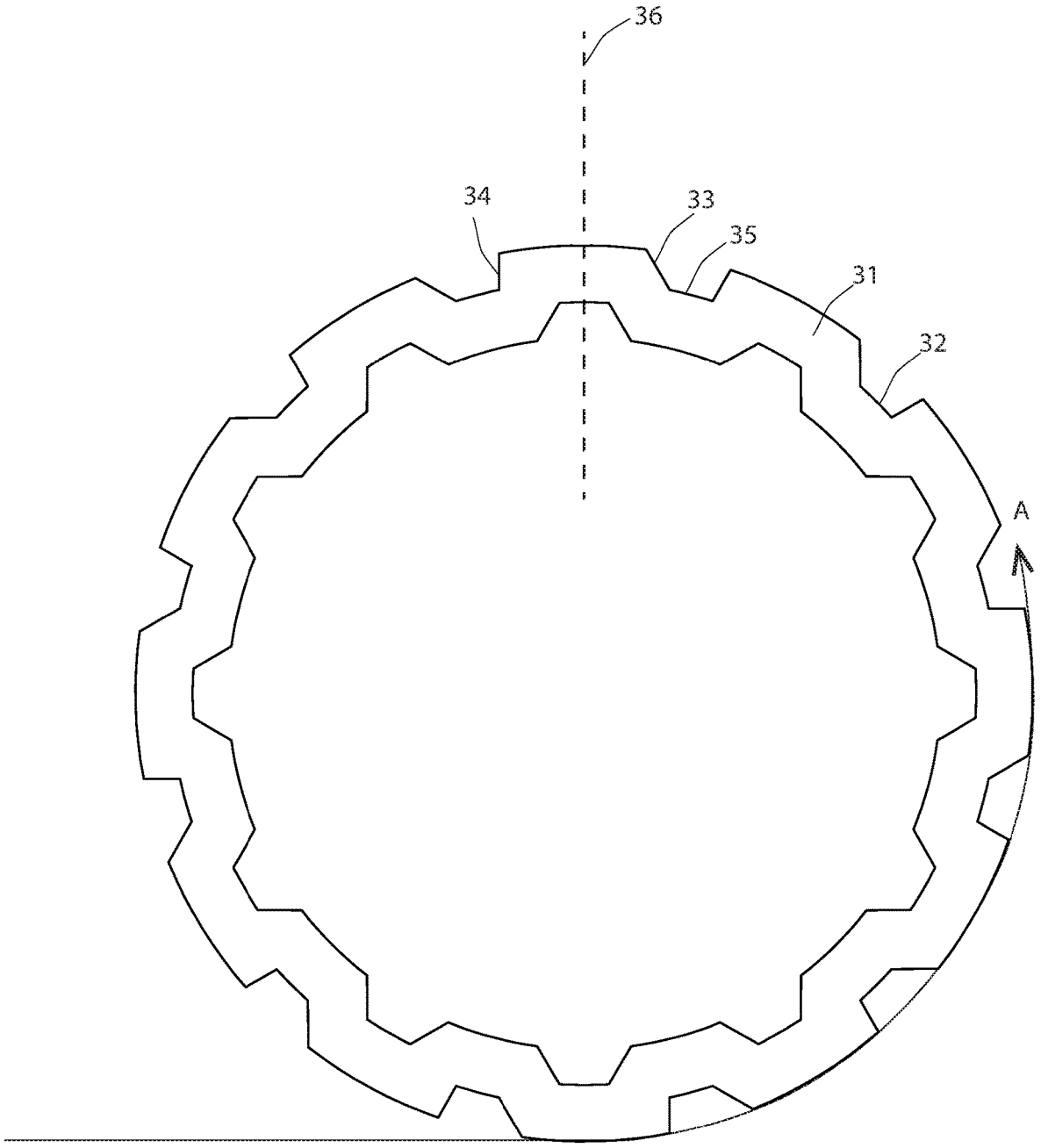
FIG. 6 is a cross sectional view of an alternative fabric roll up core with a unidirectional profile.
Figure 7:
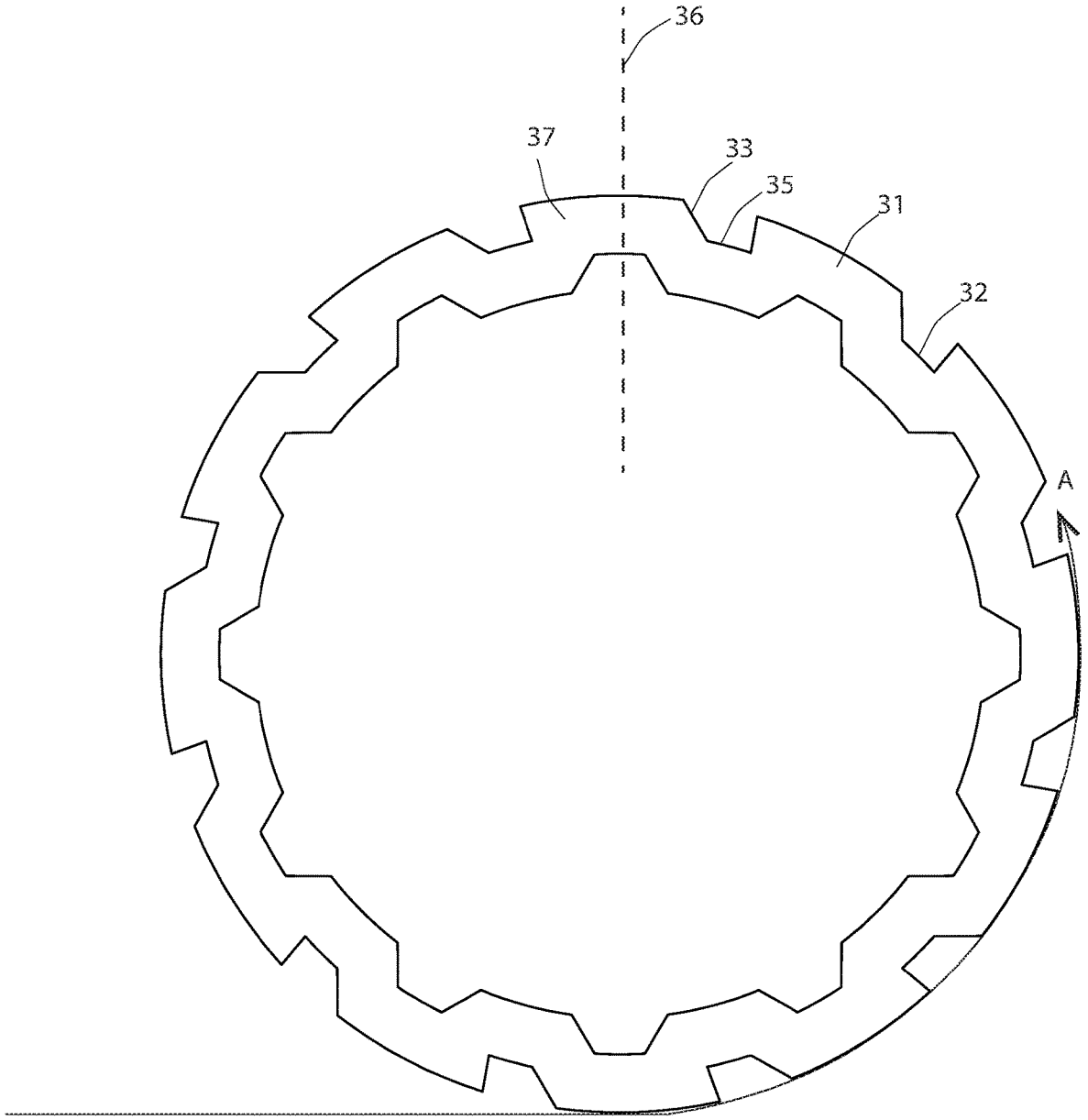
FIG. 7 is a cross sectional view of a further alternative fabric roll up core with a unidirectional profile.

In use, a sheet material may be rolled onto the fabric roll up core by rotating the fabric roll up core in the direction of arrow A in FIG. 6 or FIG. 7 so that the side (34 in FIG. 6, 37 in FIG. 7) of the rib that is adapted to grip or catch the sheet material (at least more than the other side 33 of the rib) faces forwards in the direction of rolling on to the fabric roll up core.

In some embodiments the profile on the outer surface of the fabric roll up core parts that interface with the connector also assist in maintaining the sheet material on the fabric roll up core, at least when rolling the sheet material onto the fabric roll up core.

The present invention also provides a method of winding a length of sheet material onto a fabric roll up core. The method comprises attaching a rotating drive means such as a drive shaft to the fabric roll up core such that two are rotationally locked together (i.e. such that they rotate as one). The sheet material, which may have already been partially pre-wound onto a fabric roll up core by hand, or which may be affixed to the fabric roll up core by tape or otherwise, is then wound onto the fabric roll up core by rotation of the rotating drive means. In some embodiments, the profile of the fabric roll up core is sufficient to grip the sheet material without the use of tape. The rotating drive means may be machine driven, or hand driven. The rotating drive means may drive rotation of the fabric roll up core of one end only.

The rotating drive means may be engaged to the fabric roll up core, or either first or second fabric roll up core parts of a multipart fabric roll up core, by means of a locking pin (e.g. a steel bolt). The locking pin may pass though both fabric roll up core and drive means to lock them together, or it may be in partial engagement with either or both. Alternatively, the drive means may clamp onto the inner and outer surfaces at one end of a hollow fabric roll up core, or it may clamp around part of or the entirety of the external surface of one end of the fabric roll up core. In some embodiments the fabric roll up core and drive means comprise generally complimentary profiles which engage such that the drive means and fabric roll up core are locked together such when the drive means rotates, so must the fabric roll up core. The complimentary profiles may be the outer circumferential surface of the drive means being of a profile complimentary to the inner surface of the fabric roll up core to which it engages, or the drive means may have a hollow portion with an internal circumferential surface which engages a complimentary external circumferential surface of the fabric roll up core. In such embodiments, the angle of the walls of the ribs, and the height of the ribs, on the fabric roll up core should be sufficient such that when a torque force from rotating drive means is applied the rotating drive means can drive rotation of the fabric roll up core without slippage. In some embodiments, the walls of the ribs are substantially planar and protrude from a surface of the fabric roll up core at an angle (i.e. angle x on FIG. 4B) of greater than 45°, or between about 45° and 160°. An advantage of a fabric roll up core and drive means having complimentary profiles, or of adapting the profile of the drive means so that it is complimentary to the fabric roll up core, is that the need for a locking pin (e.g. steel bolt) may be removed. Inserting and removing a locking pin can be time consuming.

In some embodiments, the angle and height of the side walls of the ribs is such that there is no slippage between the fabric roll up core and rotating drive means when the rotating drive means supplies to the fabric roll up core torque equivalent to that which may be applied by a hydraulic wheel motor, operating at 1000 psi, 1500 psi, 2000 psi, 2500 psi, 3000 psi, 3500 psi, or 4000 psi. In some embodiments the hydraulic wheel motor is a 36 cc hydraulic wheel motor. The rotating drive means may comprise a generally complimentary shape to that of the fabric roll up core.

In some embodiments, the amount of torque that may be applied by the rotating drive means without slippage occurring is at least 4 Nm, or 5 Nm, or 6 Nm or 8 Nm, 10 Nm, or 15 Nm, or 20 Nm, or 30 Nm, or 40 Nm, or 50 Nm, or 60 Nm, or 80 Nm, or 100 Nm, or 150 Nm, or 200 Nm, or 400 Nm, or 600 Nm, or 800 Nm, or 1000 Nm.

FIG. 13 is a schematic illustration of a rotating drive means 204 about to be engaged with a fabric roll up core of one embodiment of the invention 100. The arrow on the figure illustrates the direction of movement of the fabric roll up core so that it may engage the drive means. The rotating drive means is driven by a motor 201 which may be mounted to a vehicle such as a trailer (not illustrated). The drive means 204 is of similar transverse cross sectional profile to that of the fabric roll up core 100, but is larger in diameter such that the fabric roll up core 100 may be received inside the drive means and rotationally lock the drive means and fabric roll up core together (i.e. the fabric roll up core is received such that both drive means and fabric roll up core may rotate together without slippage). The rotating drive means may also include an elongated guide member 206 which may be used to guide the fabric roll up core on and off the rotating drive means, and bear the weight of the fabric roll up core (especially when it has sheet material wound upon it) when mounting or dismounting the fabric roll up core into the drive means. Using power from the motor to rotate the rotating drive means 204 and thereby also rotate the fabric roll up core 100 allows a user to wind sheet material onto the fabric roll up core. The rotating drive means may have a transverse cross-sectional profile of whatever form is appropriate to generally compliment and the fabric roll up core for which it is intended to be used with. For example, for a circular profile fabric roll up core it may be of circular profile, for square profile fabric roll up cores it may be square. The drive means may be of size and profile such that the inner surface of the drive means engages with and is complimentary to the outer surface of the end of the fabric roll up core (i.e. the drive means forming a female part and fabric roll up core a male part). Alternatively, the drive means may be of size and profile such that the outer surface of the drive means engages with and is complimentary to the inner surface of the end of the fabric roll up core (i.e. the drive means forming a male part and fabric roll up core a female part).

Figure 8:
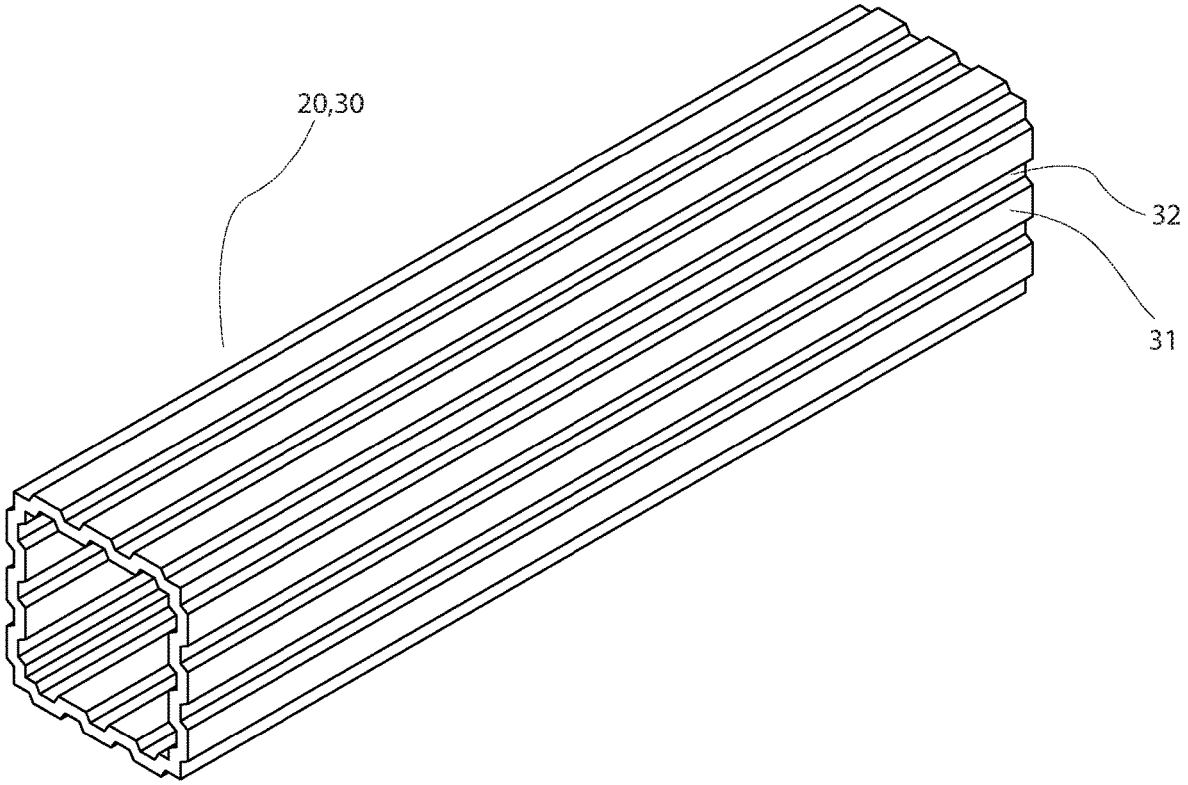
FIG. 8 is a perspective view of a fabric roll up core part of an alternative embodiment of the invention where the fabric roll up core has a square cross-sectional profile, and which when connected to a similar fabric roll up core part can be used for carrying sheet material.
Figure 9A:
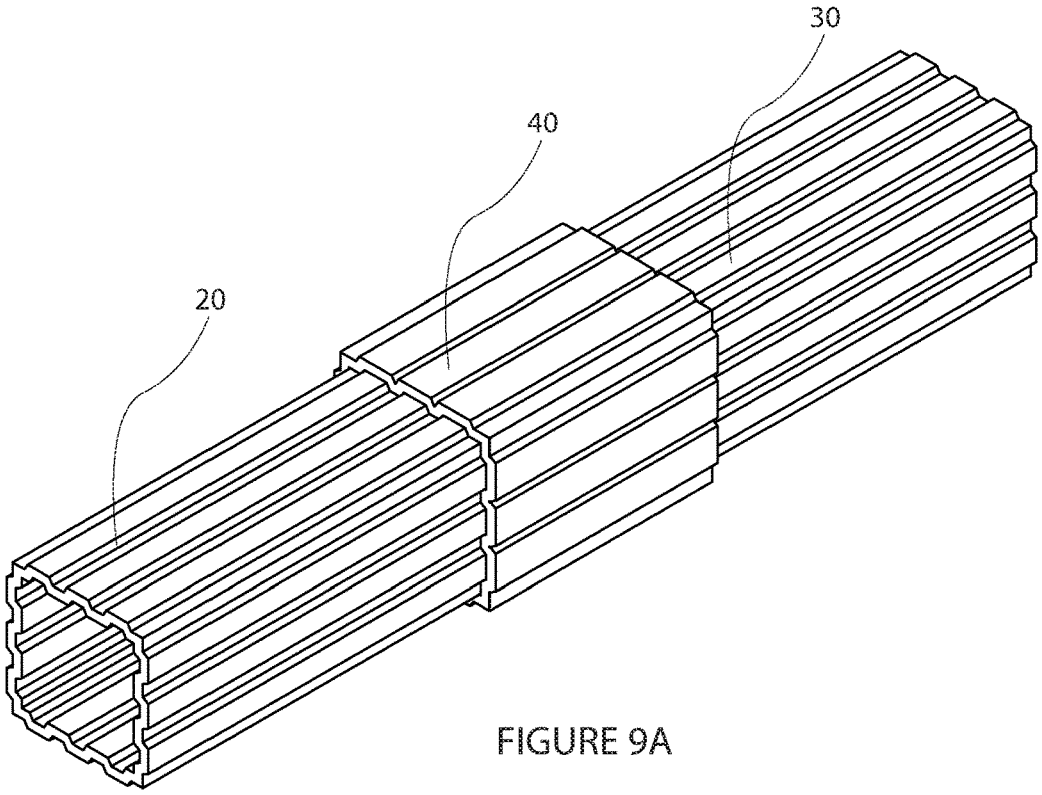
FIG. 9A is a perspective view of the fabric roll up core part of FIG. 8 joined end-to-end with a similar fabric roll up core part by a connector, in this case a sleeve.
Figure 9B:
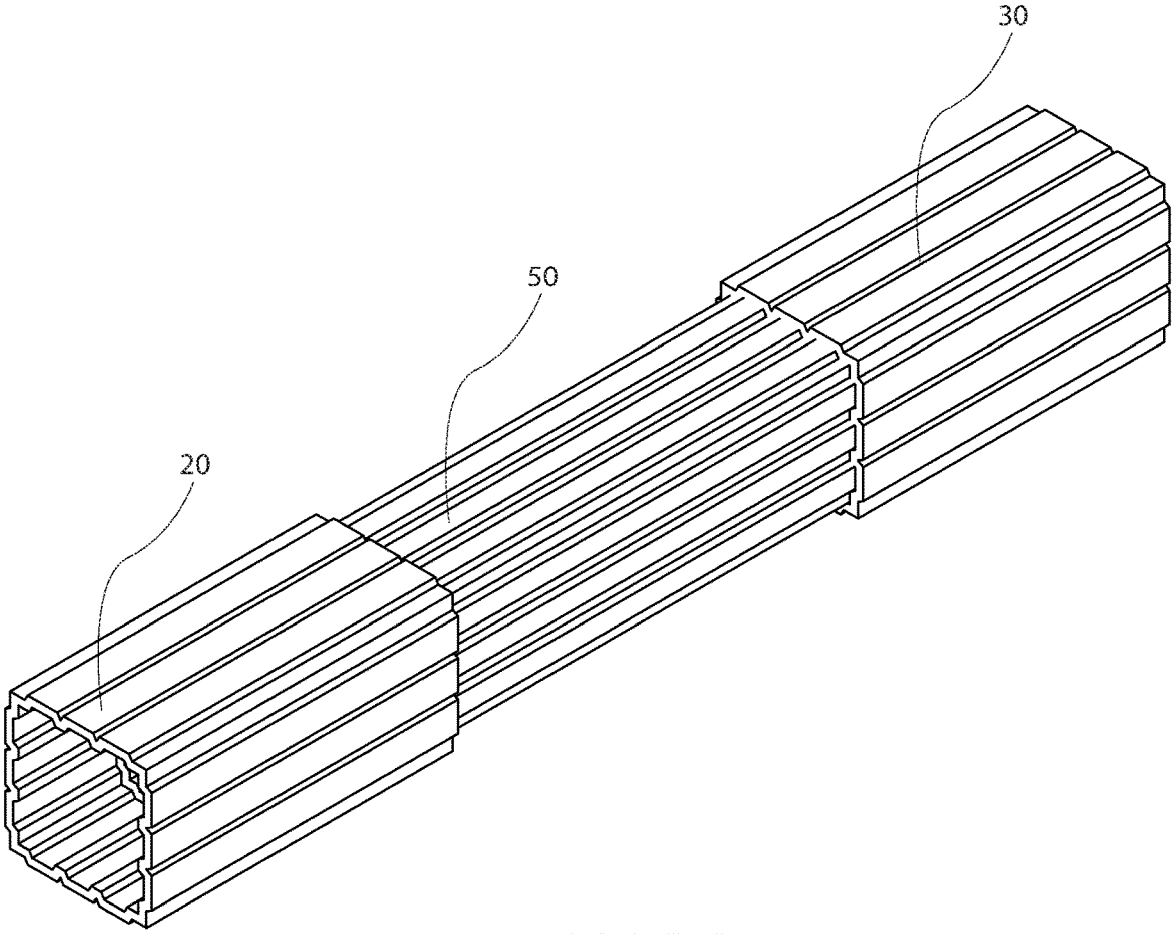
FIG. 9B is a perspective view of a fabric roll up core of an alternative embodiment joined by a dowel. The fabric roll up core is shown with the fabric roll up core parts spaced apart for purposes of illustrating the dowel, but generally in use the fabric roll up core parts would be pushed together so that they abut each other end-to-end.
Figure 10:
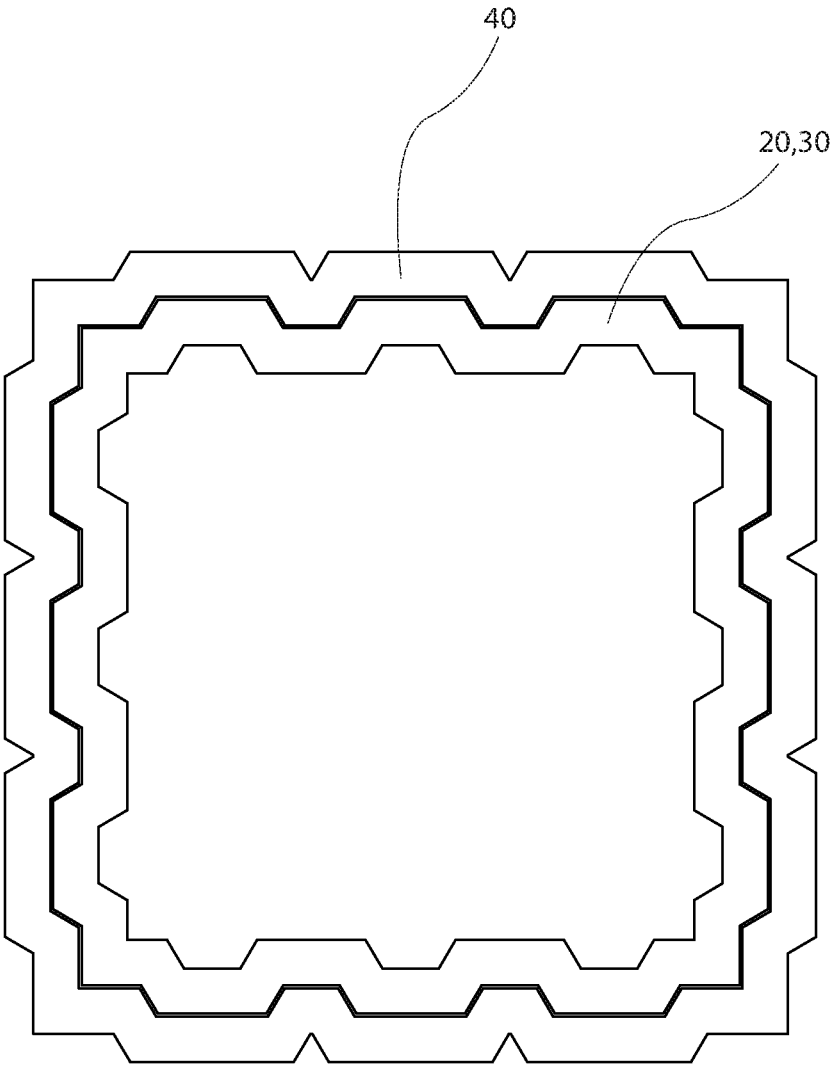
FIG. 10 is a transverse cross sectional view of the fabric roll up core and connector illustrated in FIG. 9A.
Figure 11:
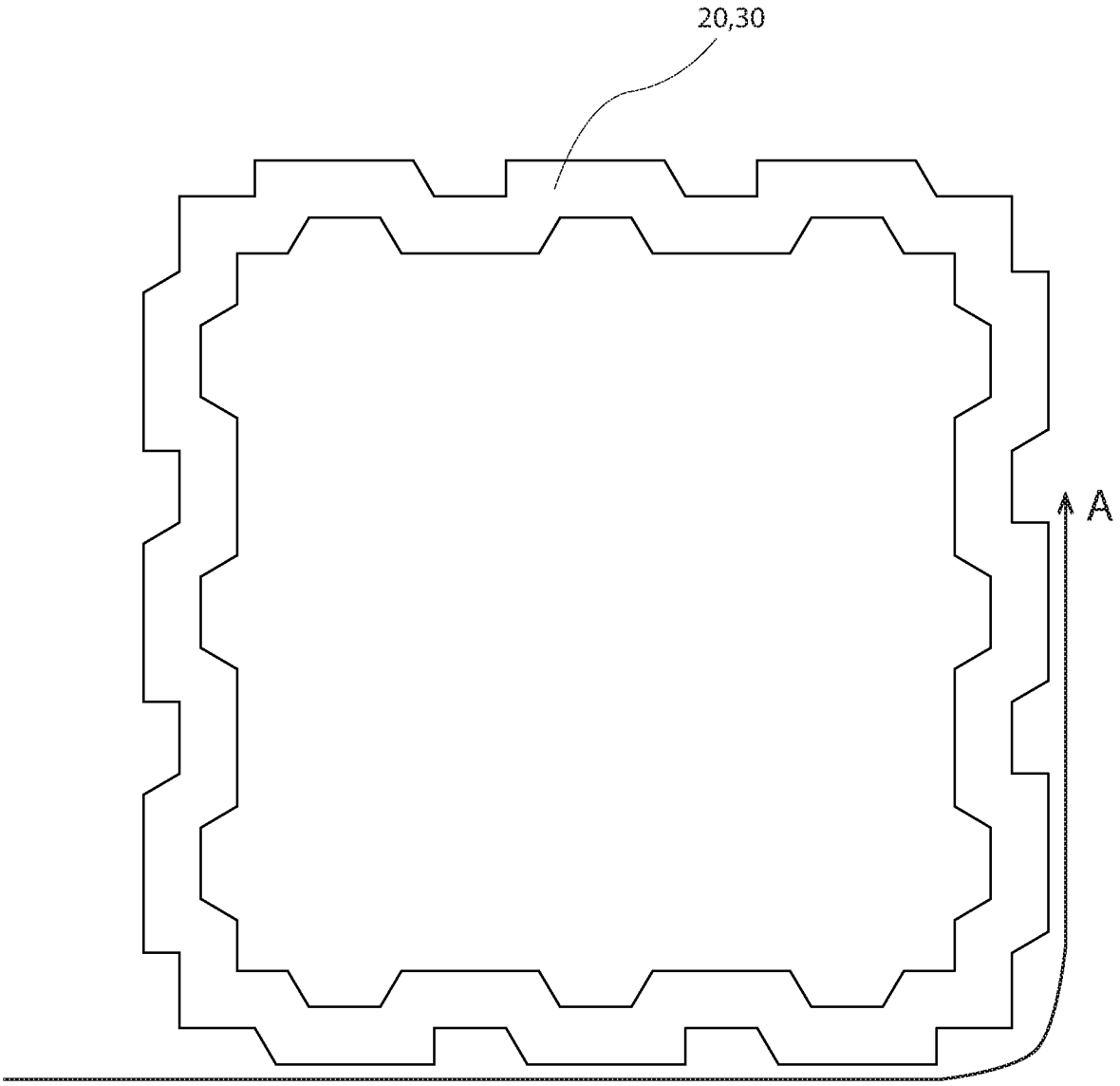
FIG. 11 is a cross sectional view of a fabric roll up core of an alternative embodiment with a unidirectional profile.
Figure 12:
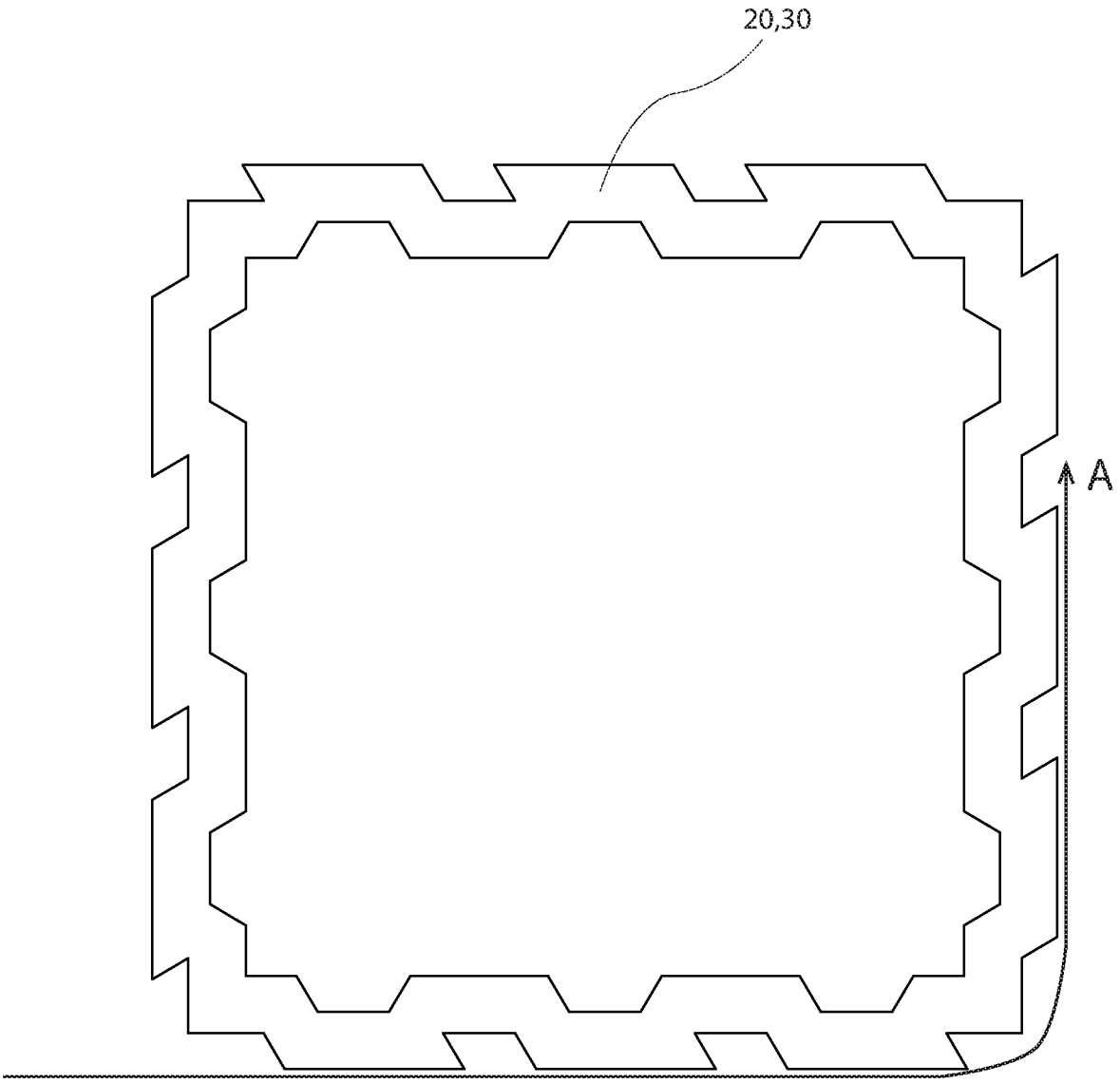
FIG. 12 is a cross sectional view of a fabric roll up core of a further embodiment with another alternative unidirectional profile.

The fabric roll up core may also be generally square in transverse cross sectional profile. FIGS. 8, 9A and 9B illustrate an embodiment of such a fabric roll up core. More specifically, FIG. 8 illustrates a fabric roll up core part (20,30), with the fabric roll up core part further illustrated in FIG. 9A joined end-to-end with a similar fabric roll up core part through use of a connector (40). In FIG. 9B, the fabric roll up core parts have been joined with a dowel (50). Similar to FIG. 3B, for the purposes of illustration, the ends of the fabric roll up core parts are spaced apart, although in use that would normally be arranged so that they abut one another. FIG. 10 is a transverse cross-sectional view of the fabric roll up core of FIG. 9A, the cross section being through a portion where fabric roll up core part (20,30) is engaged inside the sleeve (40). A square profile may be particularly advantageous when the fabric roll up core is intended for use with a rotating drive means that is also square in transverse cross section. For example, a drive means with a square cross sectional profile may engage inside and rotate a hollow fabric roll up core of similar but slightly larger square cross-sectional profile. This can be done easily and effectively without use of a locking pin. Further, as long as the cross sectional width of the drive means is large enough such that it cannot freely rotate within the fabric roll up core, the drive means may be of significantly smaller cross sectional width than the inside of the fabric roll up core with which it engages, thereby allowing plenty of "play" which is useful for quick and easy engagement, and useful to ensure the fabric roll up core can be used by a variety of different machines.

Use of the fabric roll up core is described with reference to a sheet material. The sheet material may be a ground cover sheet material. The fabric roll up core may be equally useful for other sheet materials, for example canopy sheet materials, or netting materials. For example, a netting material may be used as a drape net to be draped over a row of trees or suspended net, which is suspended on the trees tops, which is deployed and removed each year. The netting material may be stored in a roll on a fabric roll up core as described. When deploying the netting material, the netting material may be unrolled from the fabric roll up core to be draped over trees. At the end of a growing season the netting material may be rolled onto the fabric roll up core for future use. Unless otherwise stated, in this specification and claims, 'sheet material' is intended to be interpreted broadly to mean a material that may be rolled from a flat configuration on to the fabric roll up core to be held on the roll in a rolled up configuration, and includes ground sheet materials, canopy materials and netting materials.

In some embodiments the length of the fabric roll up core is greater than about 0.5 m. In other embodiments the length of the fabric roll up core may be greater than about 0.75 m, or greater than about 1 m, or greater than about 1.5 m, or greater than about 2.0 m, or greater than about 2.5 m, or greater than about 3 m, or greater than about 3.5 m, or greater than about 4.0 m, or greater than about 4.5 m, or greater than about 5 m, or greater than about 5.5 m, or about 6 m. In some embodiments the length of the fabric roll up core is less than 8 m.

In some embodiments the fabric roll up core is comprised of two or more layers. More specifically, when viewed in transverse cross-section, the roll up core may comprise two or more annular layers. Such layering may be formed by methods known in the art, such as co-extrusion or extrusion coating. In some embodiments the outermost layer may be formed of a material that has a higher coefficient of friction. This may assist in gripping a material such as a polymer based crop material being wound upon it. It may also reduce slippage at an engagement surface of a rotational drive means that engages around the roll up core. In some embodiments the innermost layer may be formed of a material that has a higher coefficient of friction, such that it assists in gripping an engagement surface of a drive means inserted inside it.

In some embodiments, one or more layers includes a material that increases the rigidity of the roll up core. In some embodiments one or more layers may comprise a glass reinforced material or may comprise fibreglass. In some embodiments one or more layers may comprise carbon fibre. In some embodiments the fabric roll up core comprises three layers and the middle layer comprises a material to provide increased rigidity, such as a layer comprising a glass reinforced material.

In embodiments where the mandrel comprises one or more parts, such as a first fabric roll up core part, a second fabric roll up core part and a connector for joining the first and second fabric roll up core parts together end-to-end, and any one or more of said parts or connector may comprise two or more layers. For example, the first and/or second fabric roll up core parts could be formed of a single layer, while the connecter is formed from two, three, or more layers, or vice versa.

The embodiments described above may also be said broadly to consist in the parts, elements and features referred to or indicated in the specification of the application, individually or collectively, and any or all combinations of any two or more said parts, elements or features, and where specific integers are mentioned herein which have known equivalents in the art to which the embodiments relates, such known equivalents are deemed to be incorporated herein as of individually set forth.

Where specific integers are mentioned herein which have known equivalents in the art to which this invention relates, such known equivalents are deemed to be incorporated herein as if individually set forth.

Example

An experiment was conducted to determine the rigidity and flex memory of a fabric roll up core of one embodiment of the invention. The fabric roll up core tested was a single part fabric roll up core having the general characteristics described above for the first and second fabric roll up core parts of the embodiment of FIG. 3A, and having a length of 2.5 m. The outer circumferential surface of each rib is about 2.5 mm above the outer circumferential surface of each trough. Specific wall thickness (distance C on FIG. 4B) and internal diameter for each of the test fabric roll up cores are set out below in Tables 2 & 4 respectively.

Figure 14:
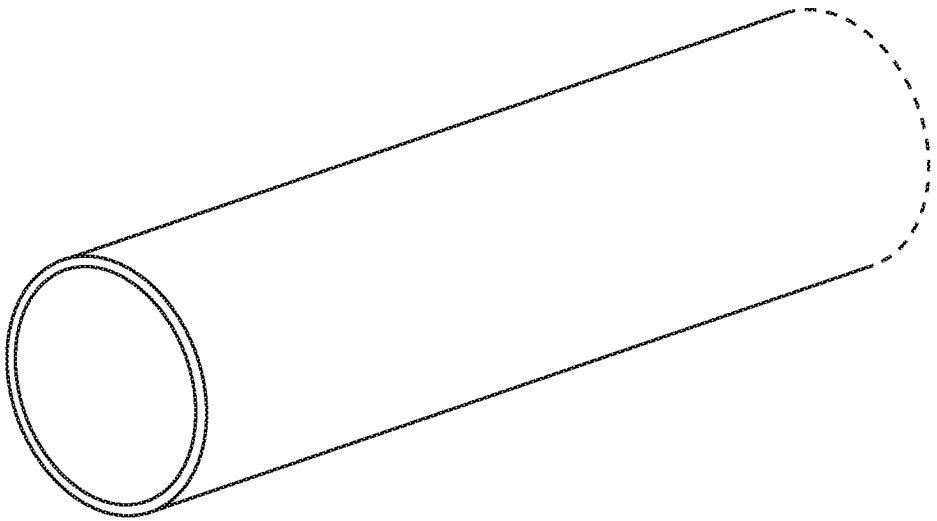
FIG. 14 is a perspective view of an end section of a fabric roll up core used as a control in an experiment herein.

Products produced by extrusion typically have minor variation in characteristics, the variation being inherent as a result of the process. Key characteristics of particular fabric roll up cores are specified in more detail below. The test fabric roll up core was compared to a control fabric roll up core which had similar wall thickness and internal diameter, made of the same material and extruded in the same manner, but without any corrugation (i.e. it had a plain circular cross-sectional profile). The control, or non-corrugated, fabric roll up core is illustrated schematically in FIG. 14.

Rigidity was tested by fixing the fabric roll up core horizontally and such that one section of the length of the fabric roll up core (from one end up to a fulcrum point) was straight and could not bend, and leaving a remaining section of either 0.5 m, 1.0 m, 1.5 m or 1.75 m length free to protrude into the air. Each fabric roll up core was tested by applying a down force to the fabric roll up core via use of a rubber cord wrapped around the fabric roll up core at a point half way between the fulcrum and the free end of the fabric roll up core, in each of the 0.5 m, 1.0 m 1.5 m and 1.75 m configurations (e.g. the rubber band was wrapped around the fabric roll up core at a distance of 0.25 m from the free end when in the 0.5 m configuration, and 0.5 m from the free end in the 1.0 m configuration). Down force was applied through a Taylor-brand 70 lb hanging spring scale, weighted to either 10 kg, 15 kg or 20 kg. The amount of bend, determined by the amount (measured in cm) of vertical movement of the free end of the fabric roll up core, was then measured.

Flex "memory" (i.e. the amount that the fabric roll up core stayed bent after bending) was tested after each rigidity test. This was tested by placing one end section of the fabric roll up core flat on a horizontal flat surface, and measuring the vertical distance (i.e. maximum vertical distance) between the flat surface and the lower edge of the fabric roll up core at very end of the other end of the fabric roll up core.

To ensure temperature and humidity consistency across fabric roll up cores, all fabric roll up cores were stored in the warehouse in which they were tested, and out of the sun. The temperature (surface) of each fabric roll up core was tested immediately before conducting rigidity and flex memory test using a Ryobi brand infrared thermometer. Each fabric roll up core was also weighed, and inner diameter (measured between the bottom of two opposing troughs) and wall thickness were measured. Three different test fabric roll up cores and three different control fabric roll up cores were tested to ensure repeatability of results. The results from the experiment are presented below.

TABLE 1

Temperature of Fabric Roll Up Cores Prior to Experiment

| | ° C. |
|---|---|
| Non-Corrugated Fabric Roll Up Core | |
| 1 | 27.6 |
| 2 | 27.4 |
| 3 | 27.5 |
| Average | 27.5 |
| Corrugated Fabric Roll Up Core | |
| 1 | 27.8 |
| 2 | 28.2 |
| 3 | 28.2 |
| Average | 28.1 |

TABLE 2

Thickness of Fabric Roll Up Core Wall

| | Thickness (mm) |
|---|---|
| Non-Corrugated Fabric Roll Up Core | |
| 1 | 4.06 |
| 2 | 4.09 |
| 3 | 4.14 |
| Average | 4.10 |
| Corrugated Fabric Roll Up Core | |
| 1 | 4.07 |
| 2 | 3.94 |
| 3 | 4.08 |
| Average | 4.03 |

TABLE 3

Weight of Fabric Roll Up Core (2.5 kg length)

| | Weight (kg) |
|---|---|
| Non-Corrugated Fabric Roll Up Core | |
| 1 | 1.64 |
| 2 | 1.63 |
| 3 | 1.58 |
| Average | 1.62 |

TABLE 3-continued

Weight of Fabric Roll Up Core (2.5 kg length)

| | Weight (kg) |
|---|---|
| Corrugated Fabric Roll Up Core | |
| 1 | 1.66 |
| 2 | 1.67 |
| 3 | 1.65 |
| Average | 1.66 |

TABLE 4

Internal Diameter of Fabric Roll Up Core

| | Internal Diameter (mm) |
|---|---|
| Non-Corrugated Fabric Roll Up Core | |
| 1 | 50.7 |
| 2 | 51.0 |
| 3 | 51.0 |
| Average | 50.9 |
| Corrugated Fabric Roll Up Core | |
| 1 | 47.8 |
| 2 | 46.4 |
| 3 | 47.9 |
| Average | 47.4 |

TABLE 5

Amount of Bend (cm) Across 50 cm of Fabric Roll Up Core

| | Bend Distance at 10 kg | Bend Distance @ 15 kg | Bend Distance @ 20 kg |
|---|---|---|---|
| Non-Corrugated Fabric Roll Up Core | | | |
| 1 | 2 | 3 | 3.5 |
| 2 | 3 | 3.5 | 4.5 |
| 3 | 2.5 | 3.5 | 4 |
| Average | 2.5 | 3.3 | 4 |
| Corrugated Fabric Roll Up Core | | | |
| 1 | 4 | 5 | 6 |
| 2 | 3 | 4 | 4.5 |
| 3 | 2.5 | 3.5 | 4 |
| Average | 3.2 | 4.2 | 4.8 |

TABLE 6

Amount of Bend (cm) Across 100 cm of Fabric Roll Up Core

| | Bend Distance at 10 kg | Bend Distance @ 15 kg | Bend Distance @ 20 kg |
|---|---|---|---|
| Non-Corrugated Fabric Roll Up Core | | | |
| 1 | 7.0 | 9.0 | 12.5 |
| 2 | 7.5 | 10.0 | 13.5 |
| 3 | 10.0 | 14.0 | 17.0 |
| Average | 8.2 | 11.0 | 14.3 |

TABLE 6-continued

| Amount of Bend (cm) Across 100 cm of Fabric Roll Up Core | | | |
|---|---|---|---|
| | Bend Distance at 10 kg | Bend Distance @ 15 kg | Bend Distance @ 20 kg |
| Corrugated Fabric Roll Up Core | | | |
| 1 | 9.5 | 12.5 | 15.0 |
| 2 | 8.0 | 11.0 | 13.0 |
| 3 | 7.5 | 10.5 | 12.5 |
| Average | 8.3 | 11.3 | 13.5 |

TABLE 7

| Amount of Bend (cm) Across 150 cm of Fabric Roll Up Core | | | |
|---|---|---|---|
| | Bend Distance at 10 kg | Bend Distance @ 15 kg | Bend Distance @ 20 kg |
| Non-Corrugated Fabric Roll Up Core | | | |
| 1 | 24.5 | 33.5 | 44.5 |
| 2 | 21.0 | 31.0 | 41.0 |
| 3 | 19.5 | 28.0 | 36.0 |
| Average | 21.7 | 30.8 | 40.5 |
| Corrugated Fabric Roll Up Core | | | |
| 1 | 19.0 | 28.0 | 36.5 |
| 2 | 18.0 | 24.0 | 32.0 |
| 3 | 19.0 | 26.0 | 33.0 |
| Average | 18.7 | 26.0 | 33.8 |

TABLE 8

| Amount of Bend (cm) Across 175 cm of Fabric Roll Up Core | | | |
|---|---|---|---|
| | Bend Distance at 10 kg | Bend Distance @ 15 kg | Bend Distance @ 20 kg |
| Non-Corrugated Fabric Roll Up Core | | | |
| 1 | 34.0 | 50.0 | 68.0 |
| 2 | 33.5 | 49.5 | 61.5 |
| 3 | 20.5 | 41.0 | 57.5 |
| Average | 29.3 | 46.8 | 62.3 |
| Corrugated Fabric Roll Up Core | | | |
| 1 | 25.5 | 37.0 | 49.5 |
| 2 | 26.0 | 37.0 | 49.0 |
| 3 | 23.5 | 34.5 | 43.5 |
| Average | 25.0 | 36.2 | 47.3 |

TABLE 9

| Flex Memory | |
|---|---|
| | Memory Distance (cm) |
| Non-Corrugated Fabric Roll Up Core | |
| 1 | 4 |
| 2 | 2 |
| 3 | 2 |
| Average | 2.7 |
| Corrugated Fabric Roll Up Core | |
| 1 | <0.5 |
| 2 | <0.5 |
| 3 | <0.5 |
| Average | 0 |

Results

Tables 5 to 8 above show the test fabric roll up core to have greater rigidity (i.e. less bend) and less flex memory.

The foregoing describes the invention including preferred forms thereof. Alterations and modifications as will be obvious to those skilled in the art are intended to be incorporated in the scope hereof, as defined in the accompanying claims.

The invention claimed is:

1. A fabric roll up core for carrying a sheet material comprising:

a profile formed on an outer surface of the fabric roll up core along a length of the fabric roll up core that assists in maintaining the sheet material on the fabric roll up core at least when rolling the sheet material onto the fabric roll up core, the profile comprising:

a plurality of ribs extending along the length of the fabric roll up core, each rib comprising first and second rib sides extending along the length of the fabric roll up core and an extending rib top bridging the first and the second rib sides along the length of the fabric roll up core, wherein the ribs around the outer surface of the fabric roll up core are asymmetrical in a transverse cross section.

2. A fabric roll up core for carrying a sheet material as claimed in claim 1 made substantially of polyolefins or polyvinyl chloride.

3. A fabric roll up core as claimed claim 1 wherein the ribs have a height of greater than 5 mm.

4. A fabric roll up core for carrying a sheet material as claimed in claim 1 wherein the rib sides are substantially planar and protrude from the surface of the fabric roll up core at an angle of at least 45°.

5. A fabric roll up core for carrying a sheet material as claimed in claim 1 having a wall thickness of between 3 and 6 mm.

6. A fabric roll up core as claimed in claim 1 wherein the first side of each rib slopes from an outer circumference of the fabric roll up core towards a centreline of the rib more than the opposite second side of the rib.

7. A fabric roll up core as claimed in claim 1 wherein the first side slopes towards the centreline of the rib and the second side is approximately aligned radially relative to the centre of the fabric roll up core.

8. A fabric roll up core as claimed in claim 1, which is generally circular in cross-sectional profile.

9. A fabric roll up core as claimed in claim 1, which is substantially square, or rectangular, or of geometric shape other than generally circular, in transverse cross sectional profile.

10. A fabric roll up core as claimed in claim 1 which has a maximum cross-sectional width, measured across the outer surface of the fabric roll up core and including any ribs, of about 20 mm to 200 mm.

11. A fabric roll up core as claimed in claim 1 wherein the profile comprises about 4 to 30 ribs spaced apart circumferentially around the fabric roll up core.

12. A fabric roll up core as claimed in claim 1 wherein a wall of the fabric roll up core comprises a plurality of radially outwardly stepped portions and a plurality of radially inwardly stepped portions, the outwardly stepped portions and the inwardly stepped portions alternating around the circumference or periphery of the fabric roll up core, the outwardly stepped portions forming the ribs of the profile extending along the length of the fabric roll up core, and the inwardly stepped portions forming the recesses of the profile along the length of the fabric roll up core.

13. A fabric roll up core for carrying a sheet material comprising:

a first fabric roll up core part;

a second fabric roll up core part; and a connector for joining the first and second fabric roll up core parts together end-to-end to form a fabric roll up core longer than the first and the second fabric roll up core parts, wherein the first and the second fabric roll up core parts each comprise a profile formed on an outer surface of the fabric roll up core that assists in maintaining the sheet material on the fabric roll up core at least when rolling the sheet material onto the fabric roll up core, the profile comprising:

at least four ribs extending along at least a major part of a length thereof, each rib comprising first and second rib sides extending along the length of the fabric roll up core and an extending rib top bridging the first and the second rib sides along the length of the fabric roll up core, wherein the ribs around the outer surface of the fabric roll up core are asymmetrical in a transverse cross section, wherein the connector comprises a complementary profile along a length of the connector, and wherein the first and the second fabric roll up core and the connector have constant cross-sectional shapes at least at or near connecting ends thereof, so that the connector and the first and second fabric roll up core parts fit together lengthwise to form the fabric roll up core longer than the first and the second fabric roll up core parts.

14. A fabric roll up core as claimed in claim 13 wherein the raised diameter portion of the fabric roll up core comprises the outer circumferential surface of the sleeve being between 2 and 8 mm higher than the outer circumferential surface of the fabric roll up core parts.

15. A fabric roll up core as claimed in claim 13 wherein the profile is formed in an outer surface of the first and second fabric roll up core parts and the complementary profile is formed in an inner surface of the connector, the connector forming a sleeve for receiving ends of the first and second fabric roll up core parts.

16. A fabric roll up core as claimed in claim 13 wherein the profile comprises:

ribs extending along the length of each of the first and second fabric roll up core parts and the complementary profile of the connector comprises recesses extending along the length of the connector for receiving the rib, or recesses extending along the length of each of the first and second fabric roll up core parts and the complementary profile of the connector comprises ribs extending along the length of connector to be received in the recesses.

17. A fabric roll up core as claimed in claim 13 wherein the profile is unidirectional around a circumference or periphery of the first and second fabric roll up core parts.

18. A fabric roll up core as claimed in claim 13 wherein a first side of each rib slopes from an outer circumference of the fabric roll up core towards a centreline of the rib more than an opposite second side of the rib.

19. A fabric roll up core as claimed in claim 13 wherein the first side slopes towards the centreline of the rib and the second side is approximately aligned radially relative to the centre of the fabric roll up core.

20. A fabric roll up core as claimed in claim 13 wherein each of said first and second fabric roll up core parts are between 0.8 and 4 m long.

21. A fabric roll up core as claimed in claim 13, comprising one or more parts, at least one of said parts comprising three annular layers when viewed in cross-section including a middle layer of the three annular layers comprises glass reinforcement.

* * * * *